US007942414B2

(12) United States Patent
Taki et al.

(10) Patent No.: US 7,942,414 B2
(45) Date of Patent: May 17, 2011

(54) IMAGE FORMING APPARATUS AND METHOD OF MANAGING DISCHARGED SHEETS

(75) Inventors: Hiroyuki Taki, Shizuoka-ken (JP); Hiroyuki Tsuchihashi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/483,165

(22) Filed: Jun. 11, 2009

(65) Prior Publication Data

US 2009/0309296 A1 Dec. 17, 2009

Related U.S. Application Data

(60) Provisional application No. 61/073,018, filed on Jun. 16, 2008, provisional application No. 61/112,633, filed on Nov. 7, 2008.

(51) Int. Cl.
*B65H 31/00* (2006.01)

(52) U.S. Cl. ..... 271/279; 399/405

(58) Field of Classification Search ..... 271/279, 271/302, 303, 213, 207; 399/405
See application file for complete search history.

(56) References Cited

U.S. PATENT DOCUMENTS

| | | | | |
|---|---|---|---|---|
| 7,594,720 | B2 | 9/2009 | Kawakami et al. | |
| 2006/0051147 | A1 * | 3/2006 | Sato et al. | 399/405 |
| 2006/0210336 | A1 | 9/2006 | Horiguchi et al. | |
| 2009/0148210 | A1 * | 6/2009 | Takenaka | 399/381 |

FOREIGN PATENT DOCUMENTS

| | | |
|---|---|---|
| CN | 1715067 | 1/2006 |
| JP | 8-339106 | 12/1996 |
| JP | 2001-253627 | 9/2001 |
| JP | 2002-332152 | 11/2002 |
| JP | 2003-73009 | 3/2003 |

OTHER PUBLICATIONS

CN Office Action, CN Appl. No. 200910149050.5, mailed Oct. 28, 2010.

* cited by examiner

*Primary Examiner* — Kaitlin S Joerger
(74) *Attorney, Agent, or Firm* — Patterson & Sheridan, LLP

(57) ABSTRACT

In so-called an image forming apparatus of an in-body paper discharging type, a technology which improves convenience of handling of sheets discharged from the apparatus is provided.

The holding unit holding a sheet received by a predetermined sheet receiver is moved between a sheet receiving position positioned above the discharge tray in a body for receiving the sheet discharged from the discharge port by the predetermined sheet receiver of the holding unit and a retracted position at which the holding unit is retracted from above the discharge tray so as to avoid the abutment with the sheet placed on the discharge tray.

14 Claims, 32 Drawing Sheets

IMAGE FORMING APPARATUS AND METHOD OF MANAGING DISCHARGED SHEETS

CROSS-REFERENCE TO RELATED APPLICATION

This application is based upon and claims the benefit of priority from: U.S. provisional application 61/073,018, filed on Jun. 16, 2008; and U.S. provisional application 61/112,633, filed on Nov. 7, 2008, the entire contents of each of which are incorporated herein by reference.

TECHNICAL FIELD

The present invention relates to a technology to manage sheets discharged from an image forming apparatus or the like.

BACKGROUND

In the related art, sheets on which images are formed by an image forming apparatus or sheets post-processed, such as sorting or stapling, after the formation of the images are discharged on a predetermined discharge tray.

However, there is a limit in number of sheets that one discharge tray accommodates. If the number of sheets to be discharged onto the discharge tray exceeds the number of sheets that the discharge tray accommodates, such as a case in which the number of printing sheets in the image forming apparatus is large, a printing job cannot be continued unless a user removes the sheets stacked on the discharge tray manually as needed.

In contrast, in the image forming apparatuses used in offices, an image forming apparatus of "in-body paper discharging type", which is a configuration for saving an installation space or for downsizing the apparatus, is known. In the image forming apparatus of the "in-body paper discharging type", the processed sheets are discharged on the paper discharge tray provided near the center of the apparatus.

However, although the image forming apparatus of the "in-body paper discharging type" is superior in space saving, a space above the paper discharge tray is occupied by a component such as a scanner, or another paper discharge tray provided immediately above the corresponding paper discharge tray, there is a problem of insufficient visibility for the user who wants to confirm the sheets on the paper discharge tray.

SUMMARY

This specification relates to an image forming apparatus including an image scanning unit arranged on an upper portion of the apparatus for scanning an image of an original document, a discharge tray provided below the image scanning unit at least partly for receiving a sheet discharged from a discharge port of the apparatus, a holding unit having a predetermined sheet receiver and holding the sheet received by the sheet receiver, and a moving mechanism configured to move the holding unit between a sheet receiving position positioned above the discharge tray for receiving the sheet discharged from the discharge port by the predetermined sheet receiver of the holding unit, and a retracted position at which the holding unit is retracted from above the discharge tray so as to avoid abutment with the sheet placed on the discharge tray.

This specification relates to a method of managing a discharged sheet in an image forming apparatus having an image scanning unit arranged on an upper portion of the apparatus for scanning an image of an original document, a discharge tray provided below the image scanning unit at least partly for receiving the sheet discharged from a discharge port of the apparatus, and a holding unit having a predetermined sheet receiver and holding the sheet received by the sheet receiver, including moving the holding unit between a sheet receiving position positioned above the discharge tray for receiving the sheet discharged from the discharge port by the predetermined sheet receiver of the holding unit, and a retracted position at which the holding unit is retracted from above the discharge tray so as to avoid abutment with the sheet placed on the discharge tray.

DETAILED DESCRIPTION

Figure 1:
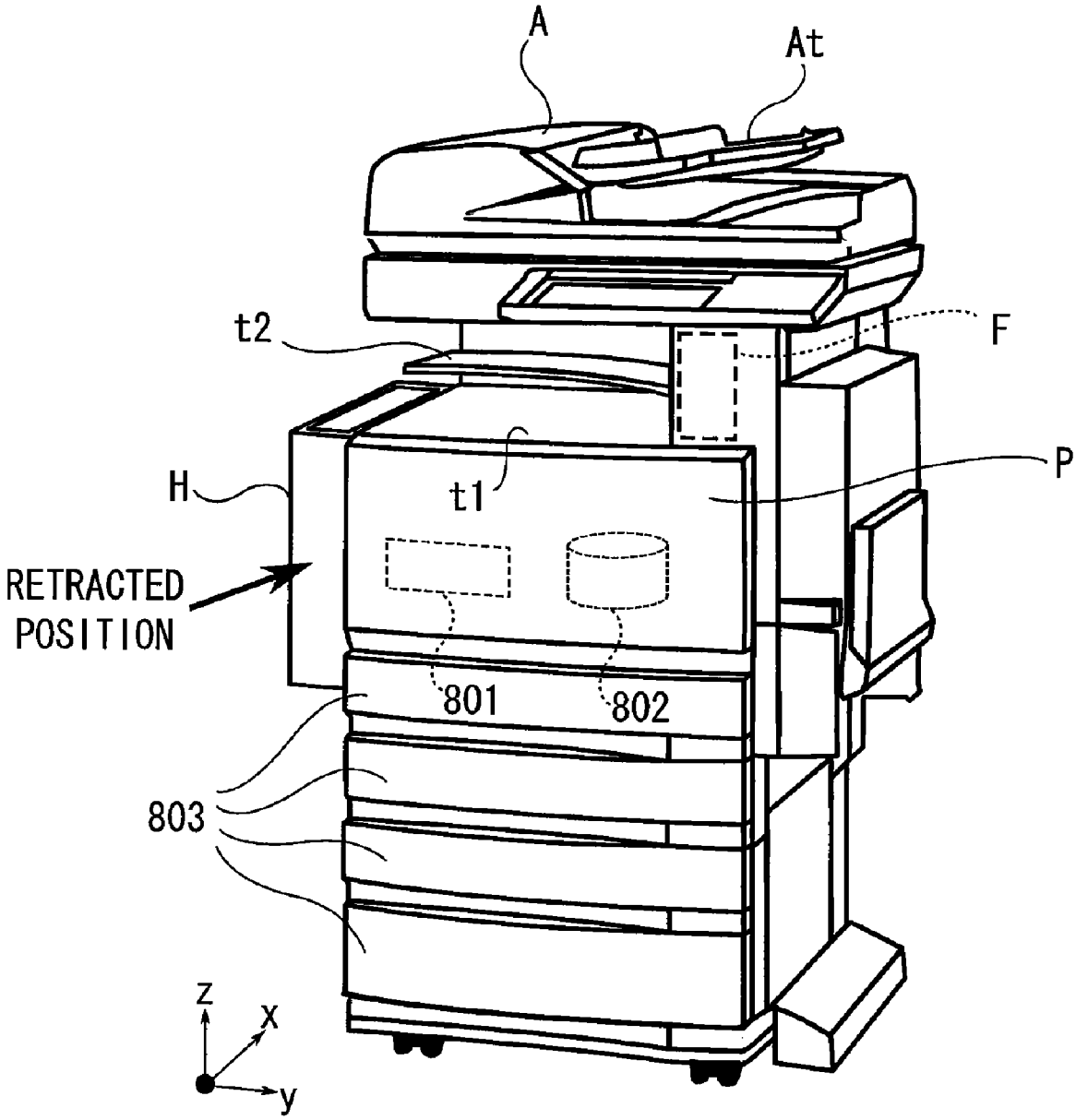
FIG. 1 is a perspective view of an image forming apparatus.

Referring now to the drawings, embodiments are described below.

FIG. 1 is a perspective view of an image forming apparatus (MFP: Multi Function Peripheral).

The image forming apparatus includes an automatic document carrying unit A, an image scanning unit R, an image forming unit P, a post-processing unit F, a first discharge tray t1, a second discharge tray t2, a holding unit H, and a moving mechanism.

The automatic document carrying unit A has a function to automatically carry a plurality of original documents placed on a tray At continuously toward a predetermined document scanning position by the image scanning unit R.

The image scanning unit R is arranged above an image forming apparatus body and has a function to scan an image of a sheet document automatically carried by the automatic document carrying unit A or a sheet document or a book document placed on a document bed, not shown.

The image forming unit P has a function to form a developer image on a sheet supplied from a paper feeding cassette K on the basis of the image scanned from the original document by the image scanning unit R or image data or the like received from an external apparatus by the image forming apparatus.

The post-processing unit F has a function to performing the post processes such as stapling, punching, book binding or the like on the sheet formed with the image by the image forming unit P. The post-processing unit F discharges a post-processed sheet bundle from a sheet discharge port.

Figure 2:
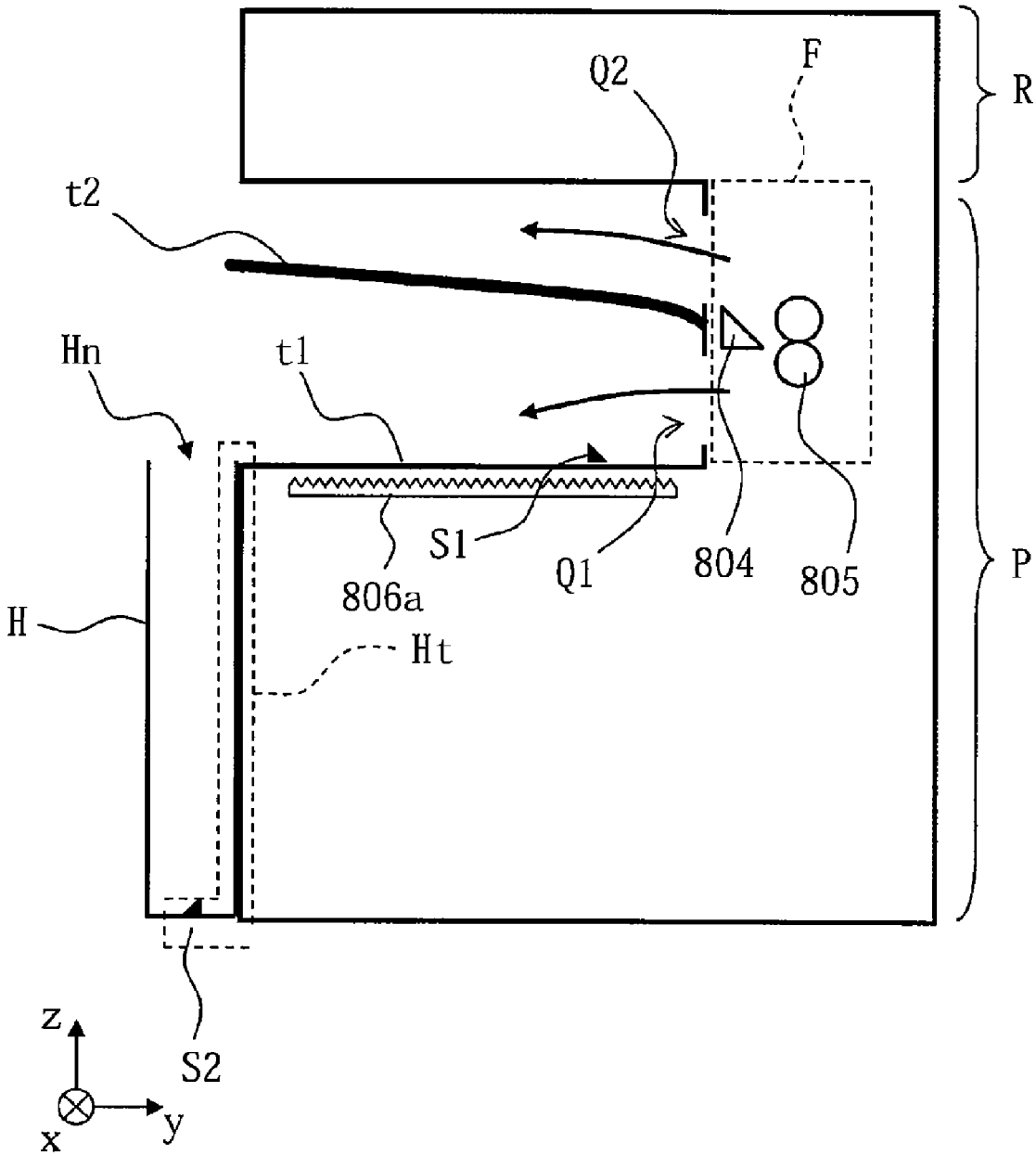
FIG. 2 is a vertical cross-sectional view of a portion near an image scanning unit R and an image forming unit P of the image forming apparatus.

The first discharge tray t1 and the second discharge tray t2 are positioned on the downstream side of the sheet discharge port. The first discharge tray t1 is located below the image scanning unit R. The first discharge tray t1 is located at least partly within a range of a footprint of the image scanning unit R. The second discharge tray t2 is located above the first discharge tray t1 and below the image scanning unit R. FIG. 2 is a vertical cross-sectional view of a portion near the image scanning unit R and the image forming unit P of the image forming apparatus.

The sheet formed with the image by the image forming unit P and the sheet post-processed by the post-processing unit F pass through a discharging path switched by a discharging destination changing flap 804 and are discharged to one of the first discharge tray t1 or the second discharge tray t2 by a discharge roller 805. The image forming apparatus is provided with a sensor S1 configured to detect whether or not a sheet is present on the first discharge tray t1.

The holding unit H includes a predetermined sheet receiver Ht and holds the sheets received by the sheet receiver Ht. Detailed description about a configuration of the holding unit H will be described later.

Figure 3:
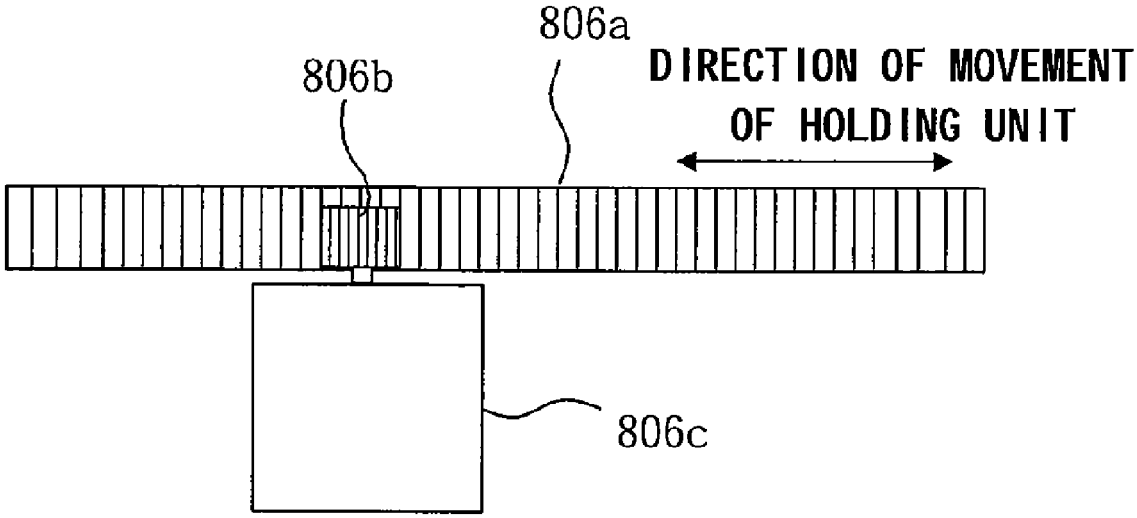
FIG. 3 is a drawing of a moving mechanism in the image forming apparatus.

FIG. 3 is a drawing of the moving mechanism in the image forming apparatus.

A rack 806*a* and a pinion 806*b* operate as the moving mechanism in cooperation with each other. Specifically, the moving mechanism moves the holding unit H between a "sheet receiving position" positioned above the first discharge tray t1 for receiving the sheet discharged from a discharge port Q1 by the predetermined sheet receiver Ht of the holding unit H and a "retracted position" at which the holding unit H is not positioned above the first discharge tray t1 so as to avoid the abutment with the sheet placed on the first discharge tray t1. The pinion 806*b* is rotated by a motor 806*c* supported by the holding unit H, and engages the rack 806*a* to move the holding unit H. A configuration in which the rack 806*a* is supported by the holding unit H and the motor 806*c* is supported by the image forming apparatus body is also applicable.

The term "hold" here means to maintain the positional relationship of the sheet received by the predetermined sheet receiver Ht with respect to the sheet receiver Ht without change when the holding unit H moves from the "sheet receiving position" to the "retracted position".

Specifically, the holding unit H is formed into a box shape having an opening Hn to receive the sheets on the side opposing the discharge port Q1 when the holding unit H is positioned at the "sheet receiving position". The holding unit H is provided with a sensor S2 configured to detect whether or not a sheet is present in the sheet receiver Ht.

In the "retracted position", the holding unit H is positioned adjacently to a side surface on the downstream side in terms of a sheet discharging direction from the discharge port Q1 from between a right side surface and a left side surface of the image forming apparatus.

As mentioned above, by causing the holding unit H to be retracted so as to extend along the right side surface or the left side surface of the image forming apparatus body, the moving holding unit H does not protrude toward the near side of the image forming apparatus (the near side in an X-axis direction in FIG. 1), so that the holding unit H does not hinder the operability of a user who operates the apparatus from the near side of the apparatus.

By providing the discharge trays at a plurality of levels, when using a plurality of functions (facsimile function, printing function, copying function, etc.) that the image forming apparatus has, discharge of the sheet on a given discharge tray is achieved on the basis of contents of the job and specifications of the user. Accordingly, an operation such that a sheet printed by the facsimile function is discharged on the first discharge tray, and a sheet printed by the copying function is discharged on the second discharge tray is enabled.

Figure 4:
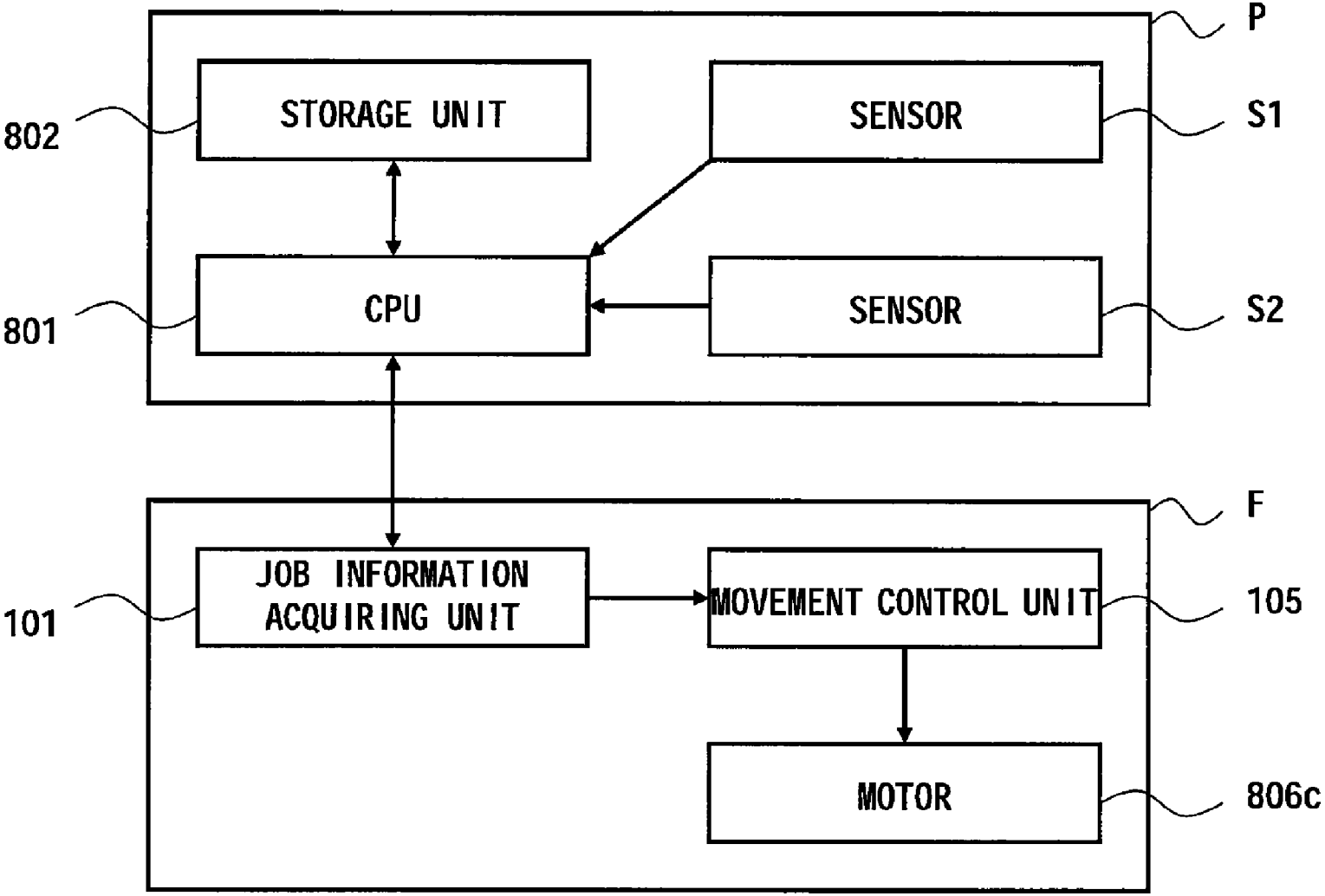
FIG. 4 is a functional block diagram of the image forming apparatus according to a first embodiment.

FIG. 4 is a functional block diagram of the image forming apparatus.

The image forming unit P of the image forming apparatus includes a CPU 801, a storage unit 802, the sensor S1 (corresponding to a sheet detecting unit), and the sensor S2 (corresponding to a full detecting unit and a holding sheet detecting unit). The CPU 801 controls the processes performed by the automatic document carrying unit A, the image scanning unit R, and the image forming unit P by executing programs stored in the storage unit 802. The sensor S1 (sheet detecting unit) detects the presence or absence of the sheet on the first discharge tray t1. The sensor S2 (full detecting unit) detects whether or not the number of sheets held in the holding unit H exceeds a predetermined marginal holdable number. The sensor S2 (holding sheet detecting unit) detects the presence or absence of the sheet held in the holding unit H.

The post-processing unit F is provided with a job information acquiring unit 101, a movement control unit 105, and the motor 806*c*. The job information acquiring unit 101 acquires information relating to the state of execution of a printing job in the image forming apparatus from the CPU 801. The job information acquiring unit 101 provides information relating to the state of the post-processing unit F and the state of the movement control unit 105 to the CPU 801. The movement control unit 105 controls the movement of the holding unit H by the moving mechanism such as the motor 806*c*, for example.

Figure 5:
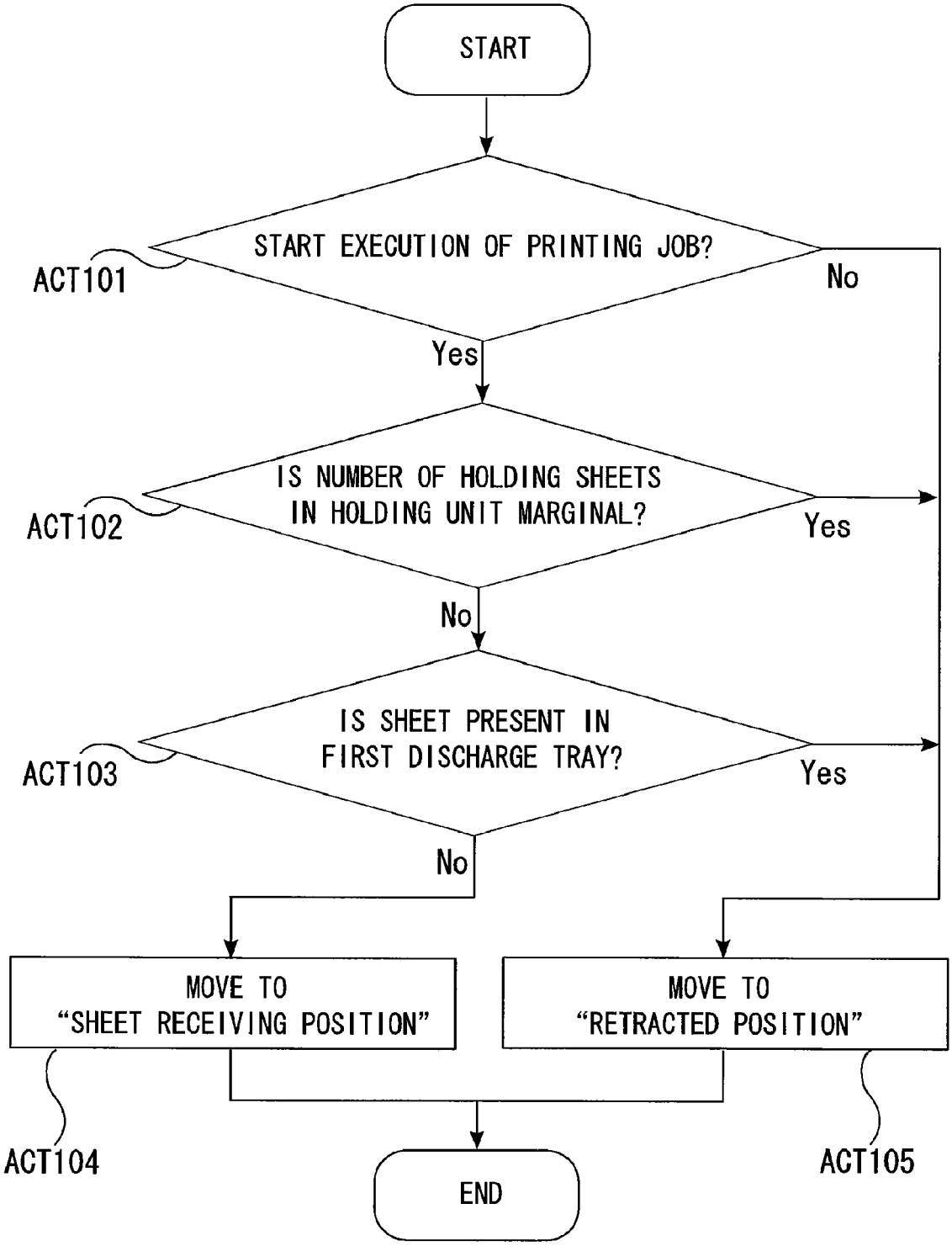
FIG. 5 is a flowchart showing a flow of movement control of a holding unit H.

FIG. 5 is a flowchart showing a flow of the movement control of the holding unit H.

The holding unit H is positioned at the "retracted position" when a power of the image forming apparatus is turned on, when the image forming apparatus is restored from a sleep state, and when the job is completed. In the flowchart shown in the same drawing, a case where the process is started from a state in which the holding unit H is in the above-described "retracted position" (state shown in FIG. 1) will be exemplified.

The movement control unit 105 determines whether or not the execution of the printing job is started in the image forming apparatus on the basis of the information acquired by the job information acquiring unit 101 (Act 101). The job information acquiring unit 101 acquires the information relating to the job executed by the image forming apparatus from, for example, the CPU 801 or the like.

If the execution of the printing job is started in the image forming apparatus (Yes in Act 101), the CPU 801 determines whether or not the sheets are held in the holding unit H by the marginal number on the basis of the result of detecting by the sensor S2 (Act 102).

If the number of sheets held in the holding unit H does not reach the marginal number, the CPU 801 determines whether or not the sheet is present on the first discharge tray t1 on the basis of the result of detecting by the sensor S1 (Act 103).

Figure 6:
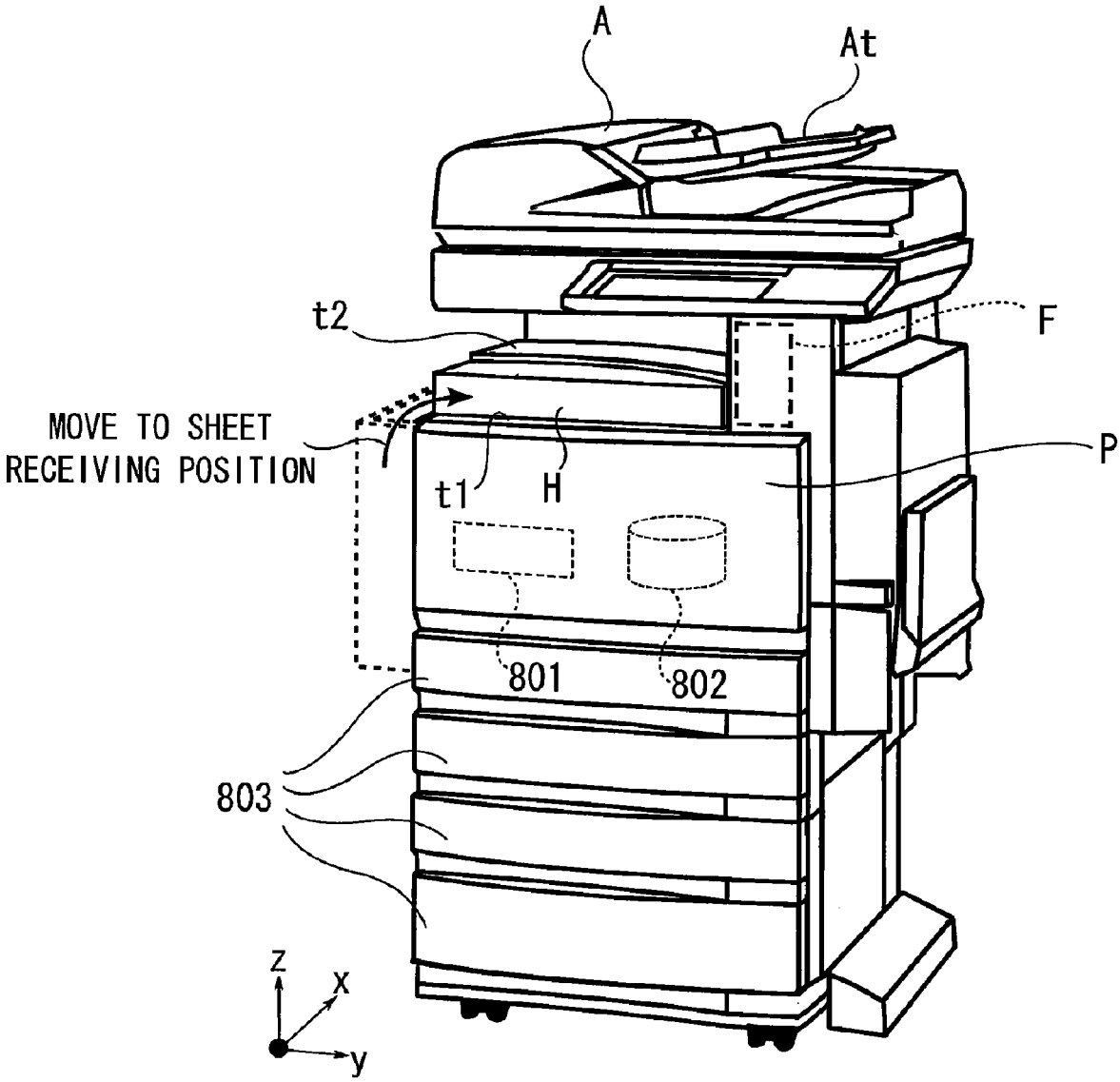
FIG. 6 is a drawing showing a state in which the holding unit H moves to a "sheet receiving position"
Figure 7:
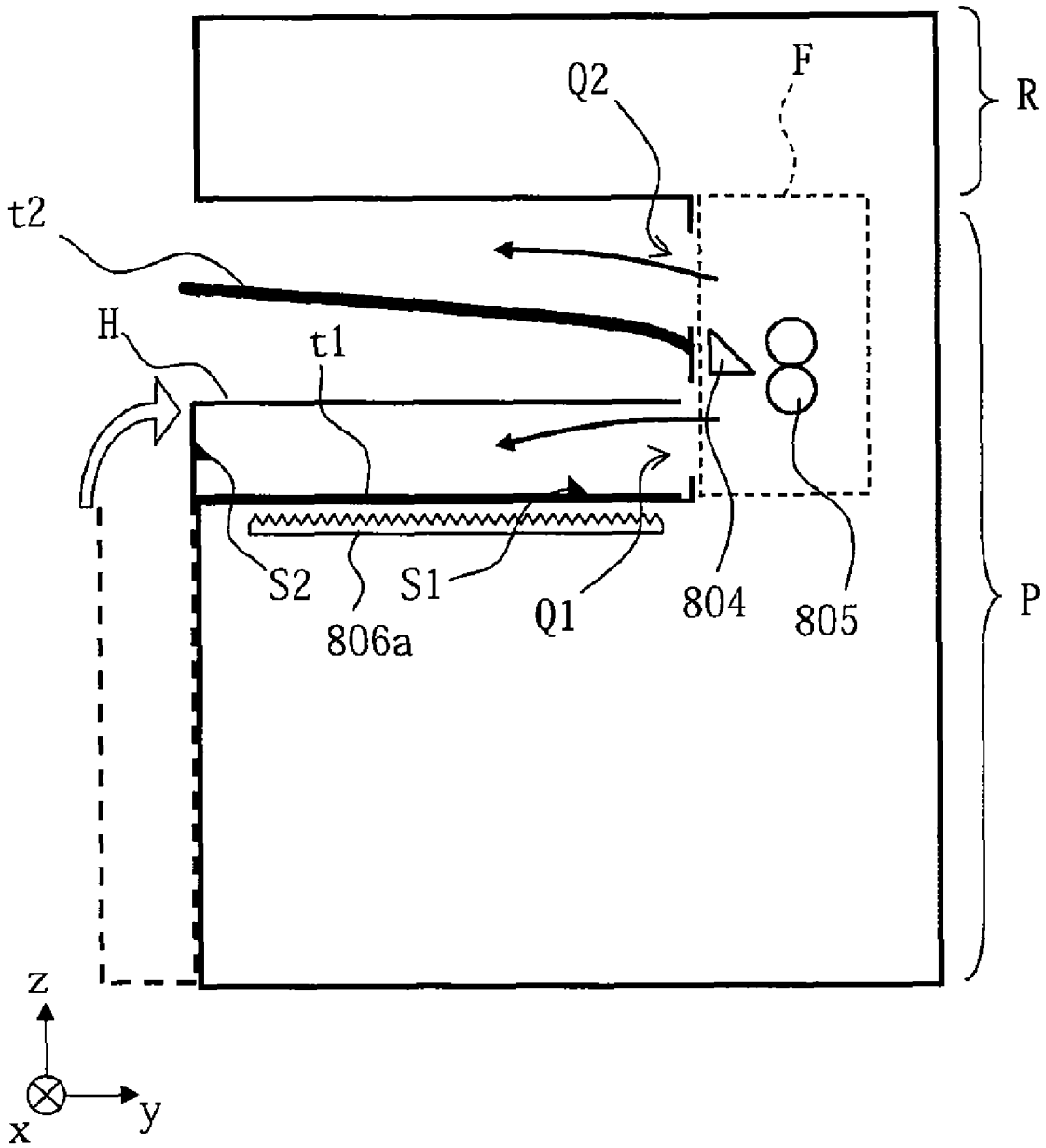
FIG. 7 is a drawing showing the state in which the holding unit H moves to the "sheet receiving position"
Figure 8:
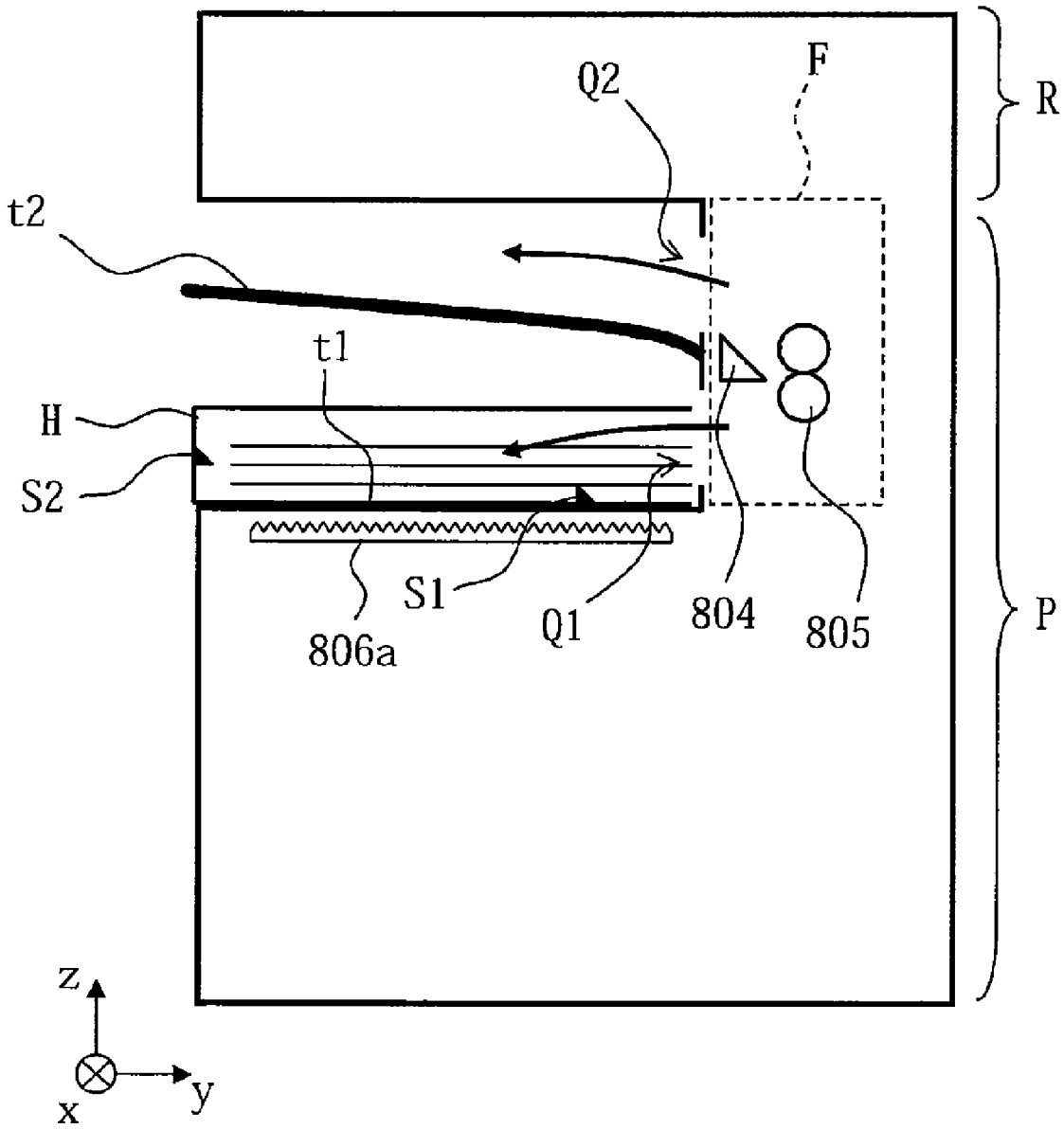
FIG. 8 is a drawing showing a state of receiving a sheet by a sheet receiver Ht of the holding unit H.
Figure 9:
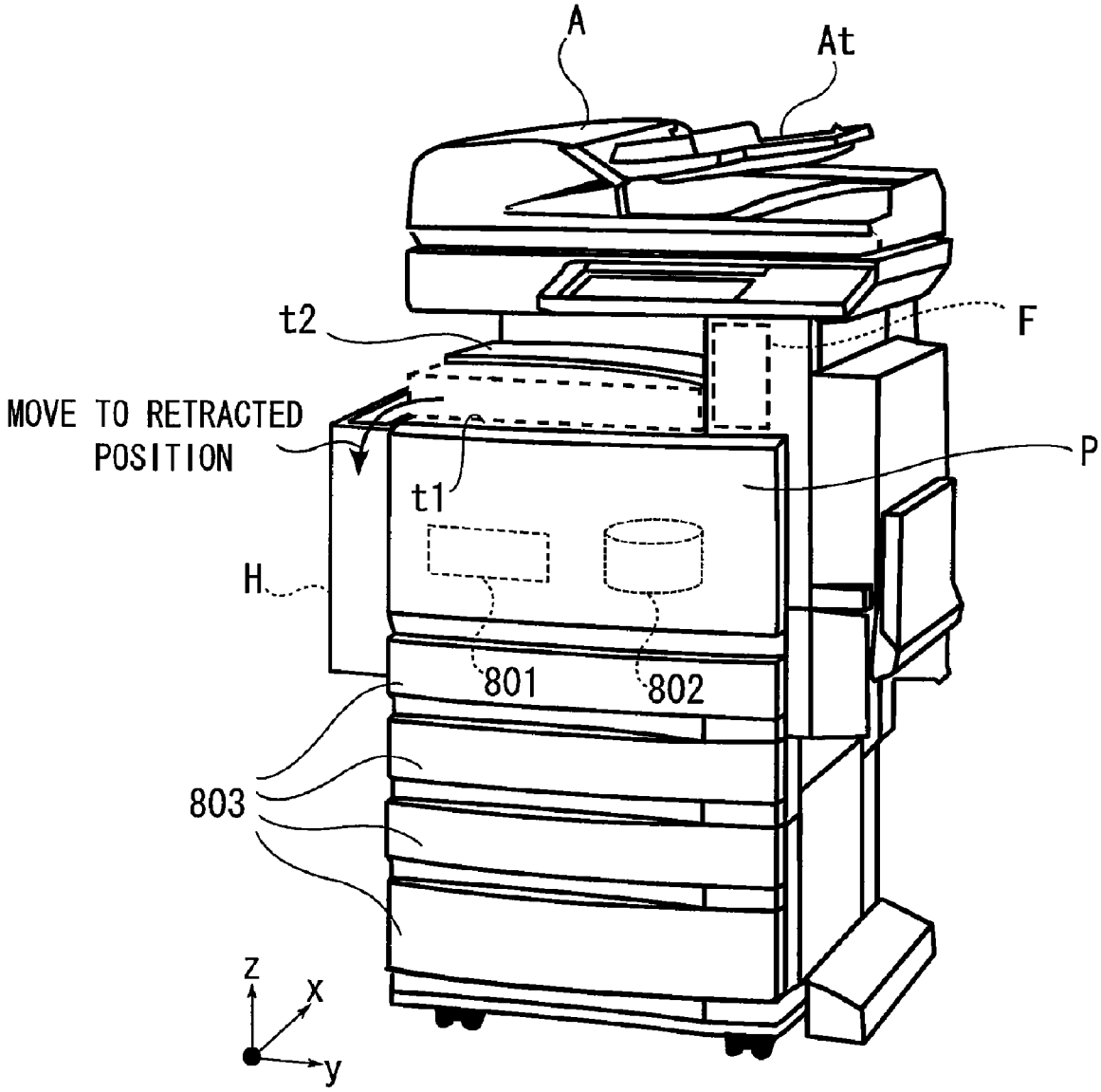
FIG. 9 is a drawing showing a state of moving the holding unit H to a "retracted position"
Figure 10:
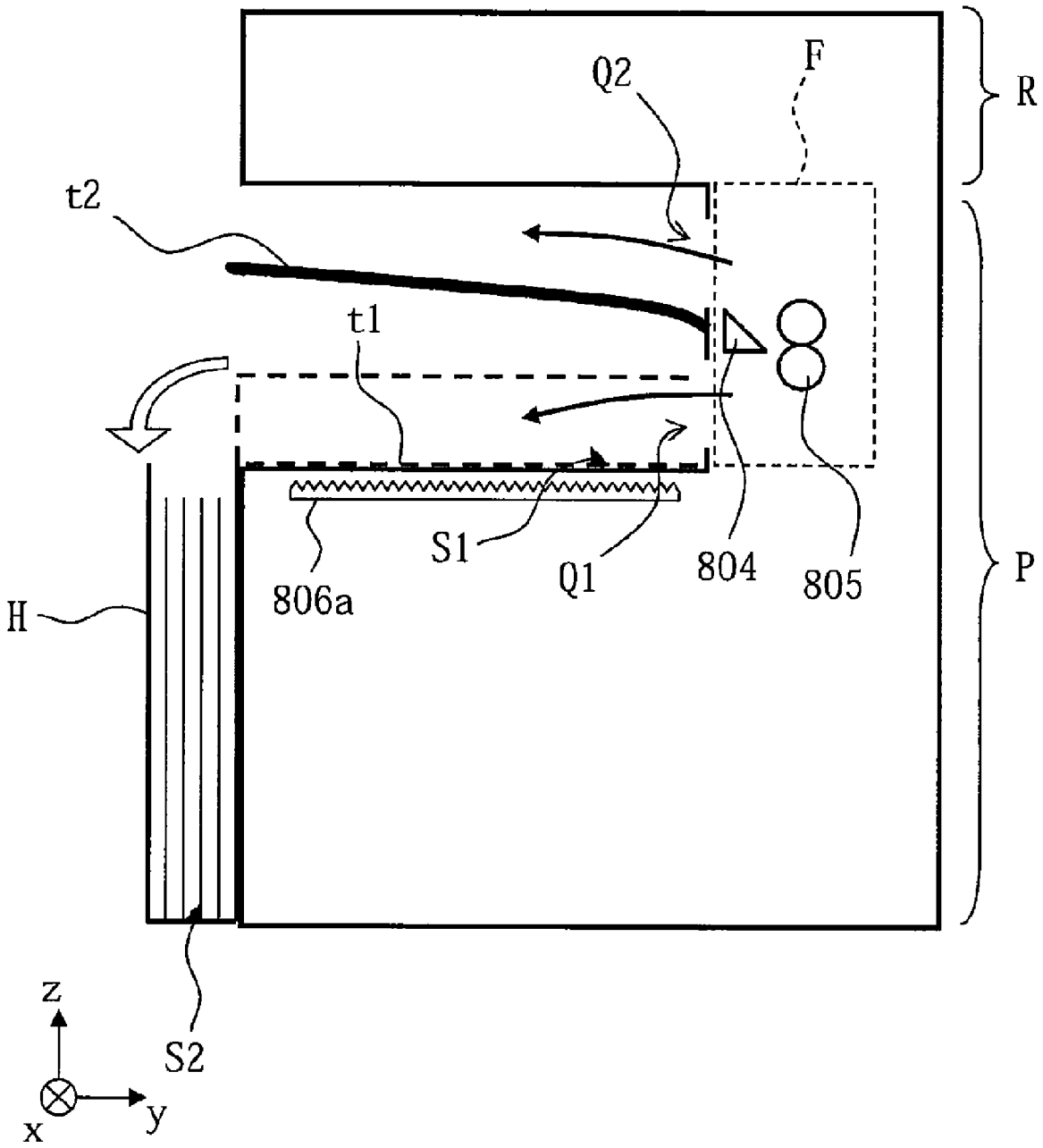
FIG. 10 is a drawing showing the state of moving the holding unit H to the "retracted position"

If there is no sheet on the first discharge tray t1 (No, in Act 103), the CPU 801 moves the holding unit H to the "sheet receiving position" (see FIG. 6 and FIG. 7) to cause the sheet receiver Ht of the holding unit H to receive the sheet (see FIG. 8), and when the execution of the printing job in the image forming apparatus is completed, the holding unit H moves to the "retracted position" (Act 104) (see FIG. 9 and FIG. 10).

In contrast, if the execution of the printing job is not started in the image forming apparatus (No in Act 101), the CPU 801 maintains the holding unit Hat the "retracted position" without moving the same to the "sheet receiving position" if the sensor S2 detects that the number of sheets held in the holding unit H reaches the marginal number to be held in the holding unit H (marginal holdable number) (Yes in Act 102) or if the sensor S1 detects that the sheet is present on the discharge tray (Yes in Act 103).

As mentioned in the above configuration, events such that the holding unit H moves to the "sheet receiving position" even though there is a sheet on the first discharge tray t1 and hence the sheet on the first discharge tray t1 is bent, or such that a new sheet is inserted into the holding unit H in a state in which the sheet is held in the holding unit H and hence the sheet jamming in the holding unit H is resulted may be avoided.

As a method of holding the sheet with respect to the sheet receiver Ht, what is required as a result is simply to enable the holding unit to hold the sheet when the holding unit moves. For example, a configuration in which the sheets are stored in the holding unit H of the box shape may be employed, or a configuration of urging the same against a plate-shaped member using a spring or the like may be employed.

As mentioned above, also when the discharge trays are provided at the plurality of levels, the problem such that the visibility of the sheet on the discharge tray on the lower level is hindered by the discharge tray on the upper level may be avoided.

Second Embodiment

Subsequently, a second embodiment will be described. The second embodiment is different from the first embodiment in the direction of movement of the holding unit.

Figure 11:
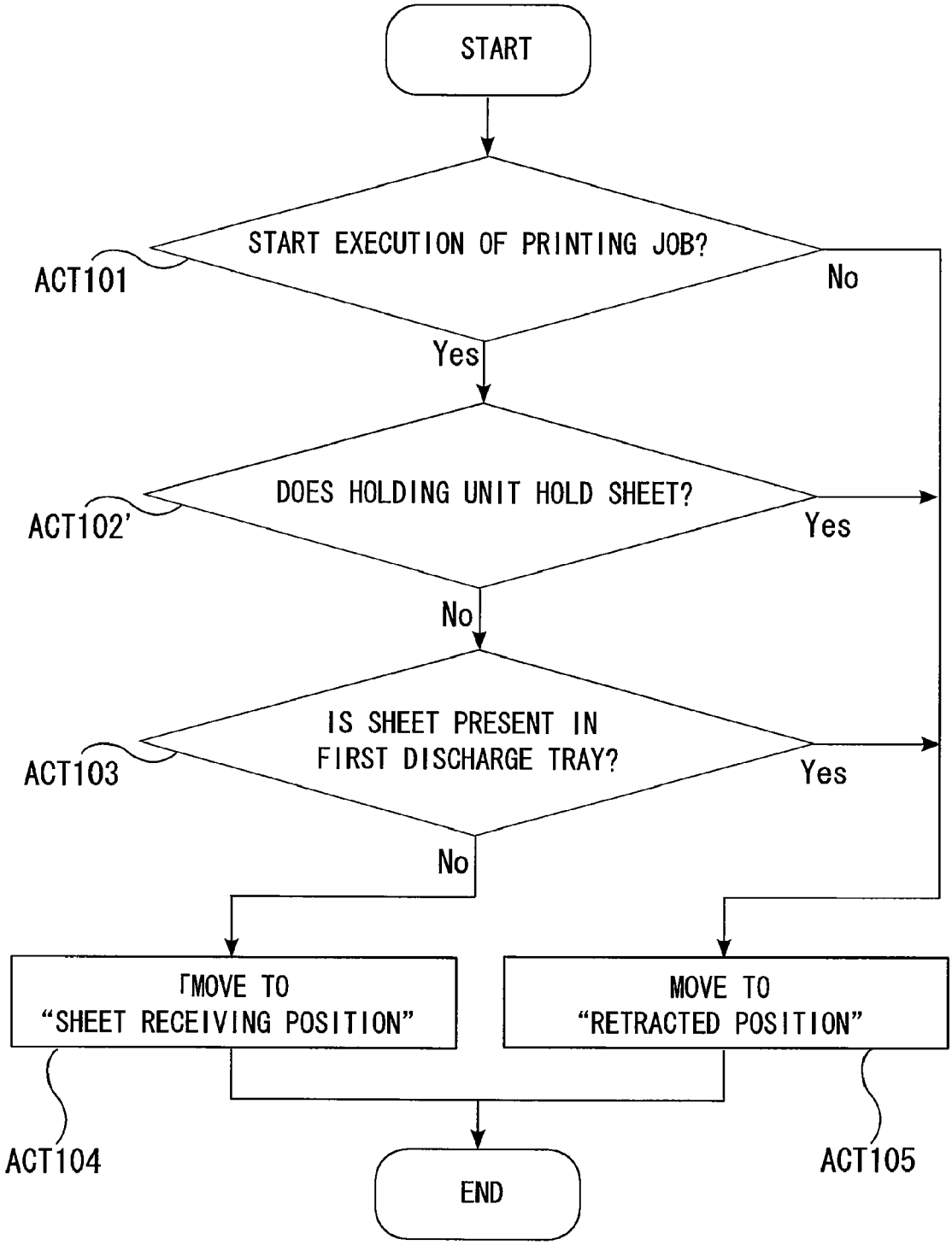
FIG. 11 is a flowchart showing a flow of movement control of the holding unit H according to a second embodiment.

FIG. 11 is a flowchart showing a flow of movement control of the holding unit H according to the second embodiment. In the flowchart shown in the same drawing, only the process corresponding to an action in Act 102 is modified.

Specifically, in Act 102' which corresponds to Act 102, if the sensor S2 detects that the sheet is not held in the holding unit H (No in Act 102'), the procedure goes to Act 103.

If the sensor S2 detects that the sheet is held in the holding unit H (Yes in Act 102'), the movement control unit 105 maintains the holding unit H at the "retracted position" without moving the same to the "sheet receiving position".

In the second embodiment, even when the number of sheets held in the holding unit H is small, if the number of sheets continuously carried into the holding unit H is large, the holding unit H considers the possibility of occurrence of the sheet jamming in the holding unit H, so that the movement to the "sheet receiving position" is prohibited if a sheet is held in the holding unit H.

Third Embodiment

Subsequently, a third embodiment will be described. The third embodiment is different from the first embodiment in the direction of movement of the holding unit.

Figure 12:
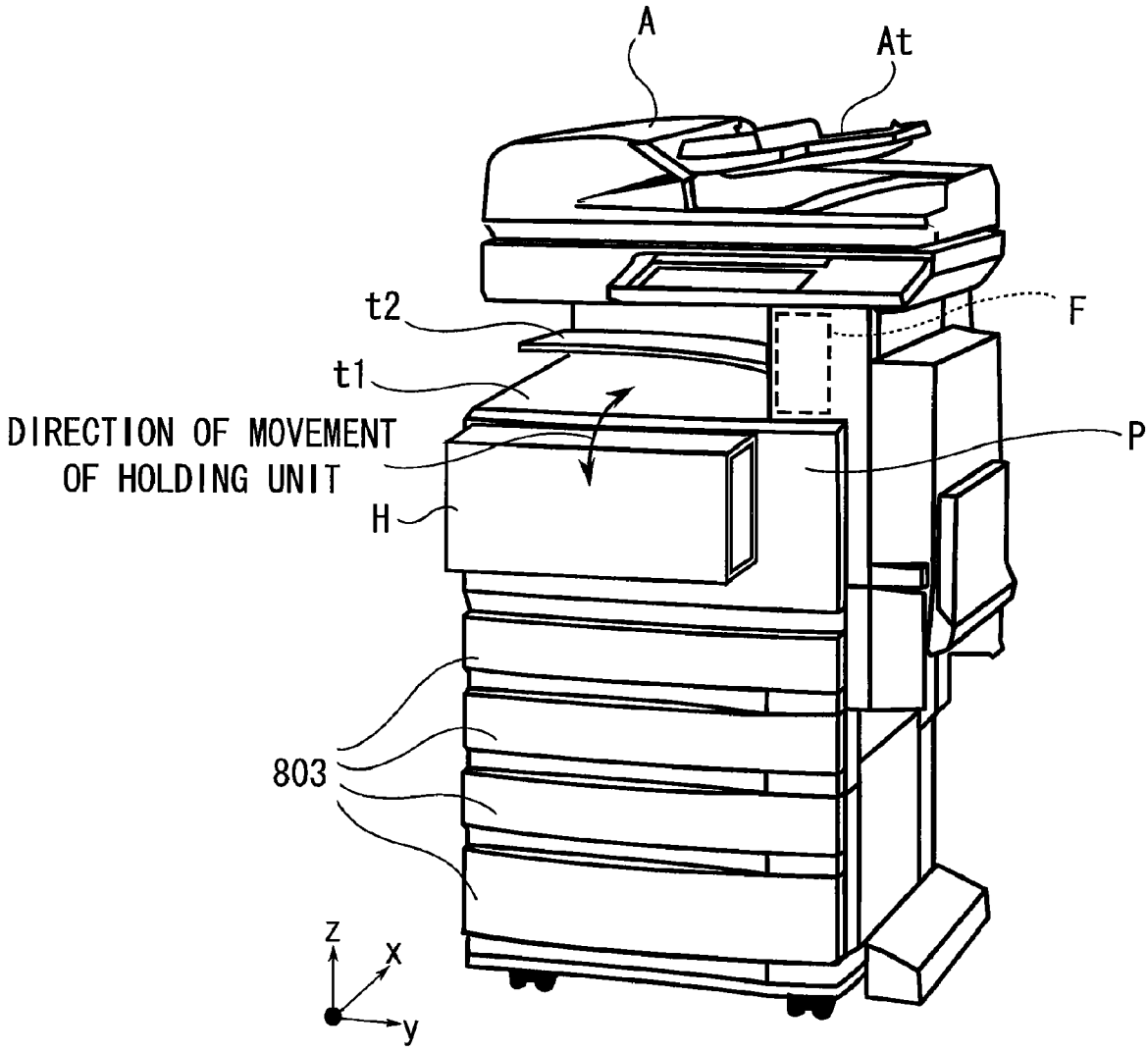
FIG. 12 is a perspective view showing an appearance of the image forming apparatus according to a third embodiment.

FIG. 12 is a perspective view showing an appearance of the image forming apparatus according to the third embodiment.

The holding unit H is provided so as to be capable of moving in the direction of movement indicated by an arrow by the moving mechanism, not shown, and is configured to be placed adjacently to a side surface on the front side of the image forming apparatus in the "retracted position".

As mentioned above, with a configuration in which the holding unit H is retracted toward the near side of the image forming apparatus body, a space on the near side of the image forming apparatus body which is secured normally may be effectively utilized. Also, with a configuration in which the holding unit H moves toward the near side of the apparatus, a space specific for moving the holding unit H does not have to be provided on the left and right side surfaces side of the image forming apparatus, which contributes also to reduction of an installation space.

The movement control unit 105 has a function to control the movement of the holding unit H by the moving mechanism.

The movement control unit 105 sorts the sheets to be stacked on the sheet receiver Ht of the holding unit H by controlling the movement of the holding unit H within the range of movement from the "sheet receiving position" to the "retracted position".

As mentioned above, by using the moving mechanism for the holding unit H for retracting the sheets to be discharged from the apparatus from the first discharge tray t1 also for sorting of the sheets, the effective utilization of the moving mechanism is achieved, which contributes also to the multi-functioning of the apparatus.

Fourth Embodiment

Subsequently, a fourth embodiment will be described.

Figure 13:
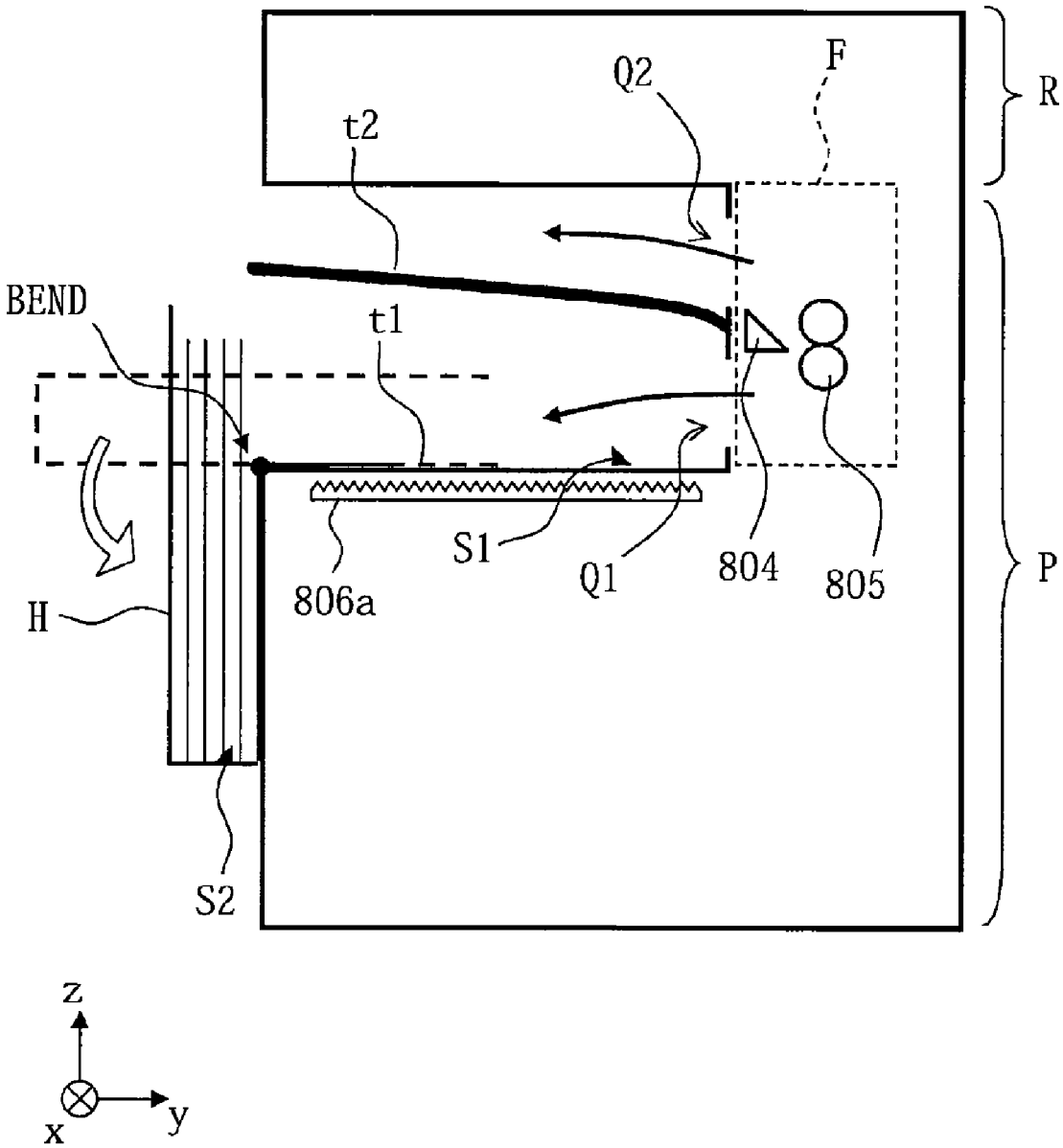
FIG. 13 is a configuration drawing of a configuration of the image forming apparatus according to a fourth embodiment.

FIG. 13 is a configuration drawing of a configuration of the image forming apparatus according to the fourth embodiment.

As shown in the same drawing, a holding unit H' has a configuration in which a wall surface corresponding to the first discharge tray t1 is bendable at least when the holding unit H' moves.

Accordingly, when the holding unit H' moves between the "retracted position" and the "sheet receiving position" by the moving mechanism, the extent of outward protrusion thereof from the image forming apparatus is reduced. The above configuration contributes to space saving of the installation space of the image forming apparatus and improvement of convenience of the user's operation.

Fifth Embodiment

Figure 14:
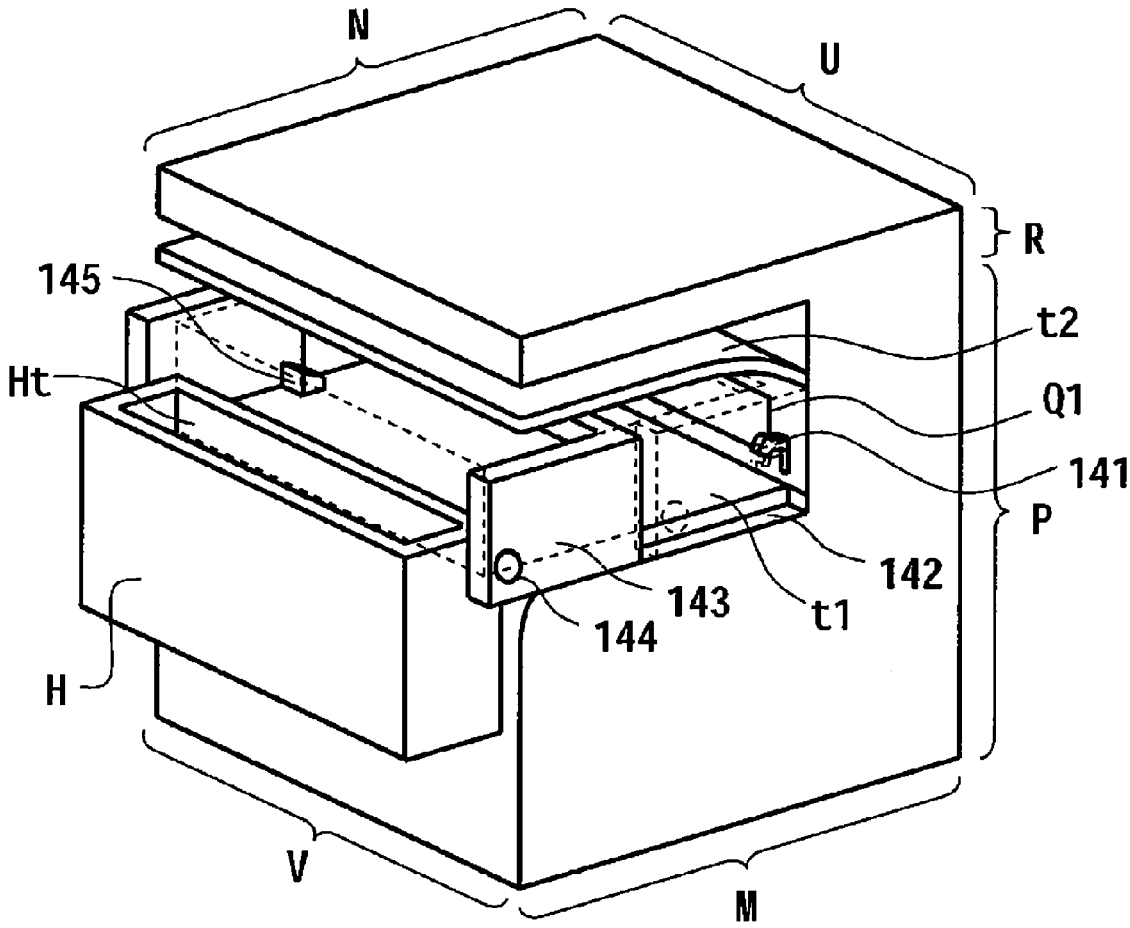
FIG. 14 is a perspective view of the image forming apparatus according to a fifth embodiment.

FIG. 14 is a perspective view of the image forming apparatus. In the description, the side indicated by M in FIG. 14 is a front side of the image forming apparatus and, in the same manner, the side indicated by N is a rear side, a side indicated by V is a left aide, and the side indicated by U is a right side. The image forming apparatus includes the image forming unit P and the image scanning unit R.

The image forming unit P includes the first discharge tray t1 on an upper surface thereof. The image forming unit P includes the discharge port Q1 on an upper right of the first discharge tray t1. The image forming unit P includes rails 142 respectively on the front side and the rear side of the first discharge tray t1.

A supporting frame 143 is bridged between the rails 142 on the front side and the rear side. The supporting frame 143 slides rightward and leftward on the rails 142. The length of the supporting frame 143 in the direction from the front side to the rear side preferably falls within a footprint of the image forming unit P. Furthermore, the length of the supporting frame 143 from the front side to the rear side is preferably falls within the footprint of the image scanning unit R. The supporting frame 143 supports the holding unit H so as to rotate about a rotating shaft 144 between a standing position and a face-up position. If the supporting frame 143 moves to a leftmost position of the rails 142, the rotating shaft 144 moves out from a footprint of the first discharge tray t1. Then, the holding unit H is no longer supported by the first discharge tray t1 and hence rotates about the rotating shaft 144 downward and then assumes the standing position. In the standing position, the sheet receiver Ht may be oriented vertically, but may be oriented between 45 degrees and 90 degrees inclusive with respect to the horizontal direction.

The image forming unit P includes stoppers 141 on the front side and the rear side of the discharge port Q1. The stoppers 141 engage connectors 145 of the supporting frame 143.

Figure 15:
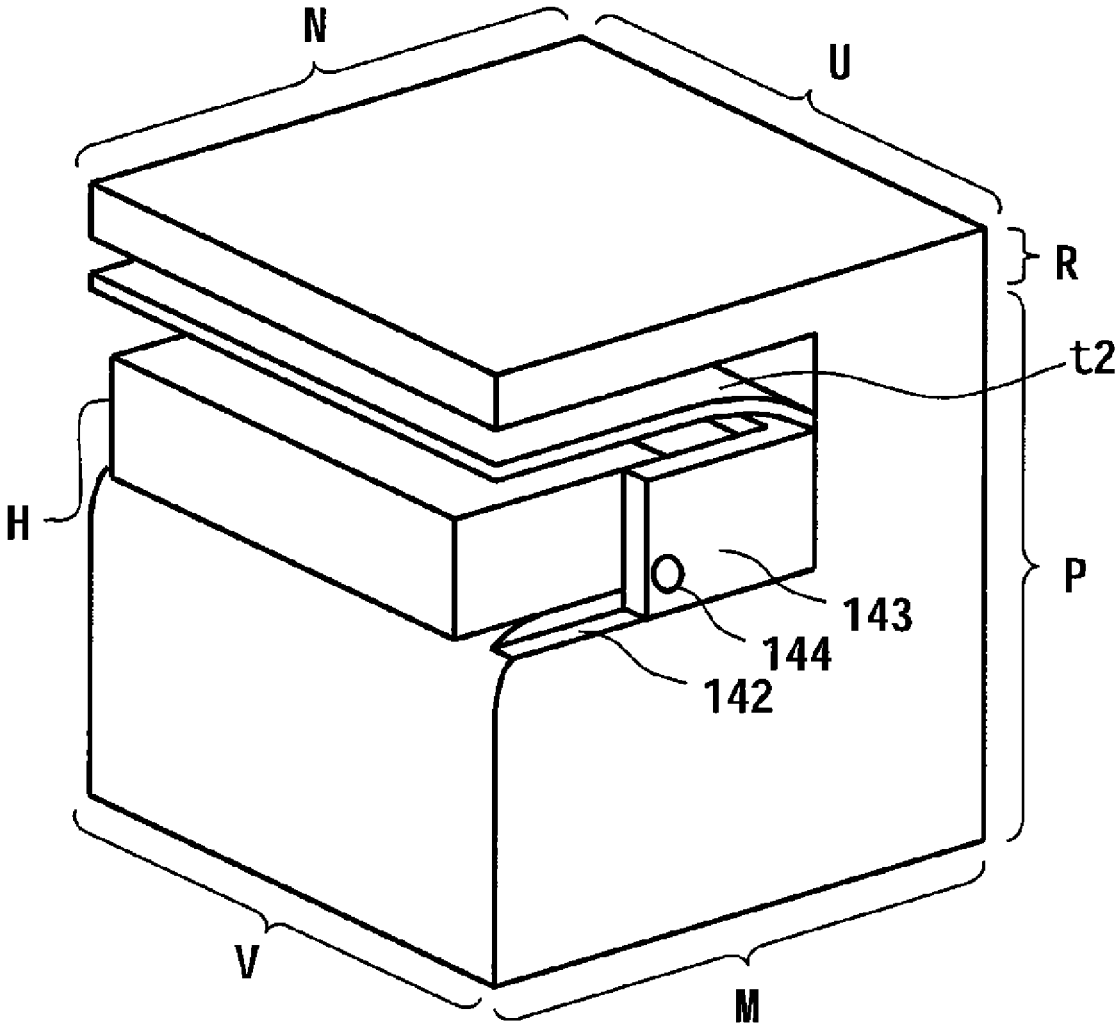
FIG. 15 is a perspective view of the image forming apparatus having the holding unit stored therein.

FIG. 15 is a perspective view of the image forming apparatus having the holding unit H stored therein. When the supporting frame 143 moves to a rightmost position of the rails 142, the holding unit H is supported on the right side thereof by the first discharge tray t1 and assumes the face-up position. In the face-up position, the sheet receiver Ht may be oriented horizontally, but may be oriented 45 degrees or smaller with respect to the horizontal direction. The holding unit H in the face-up position preferably falls within the footprint of the image forming unit P.

Figure 16:
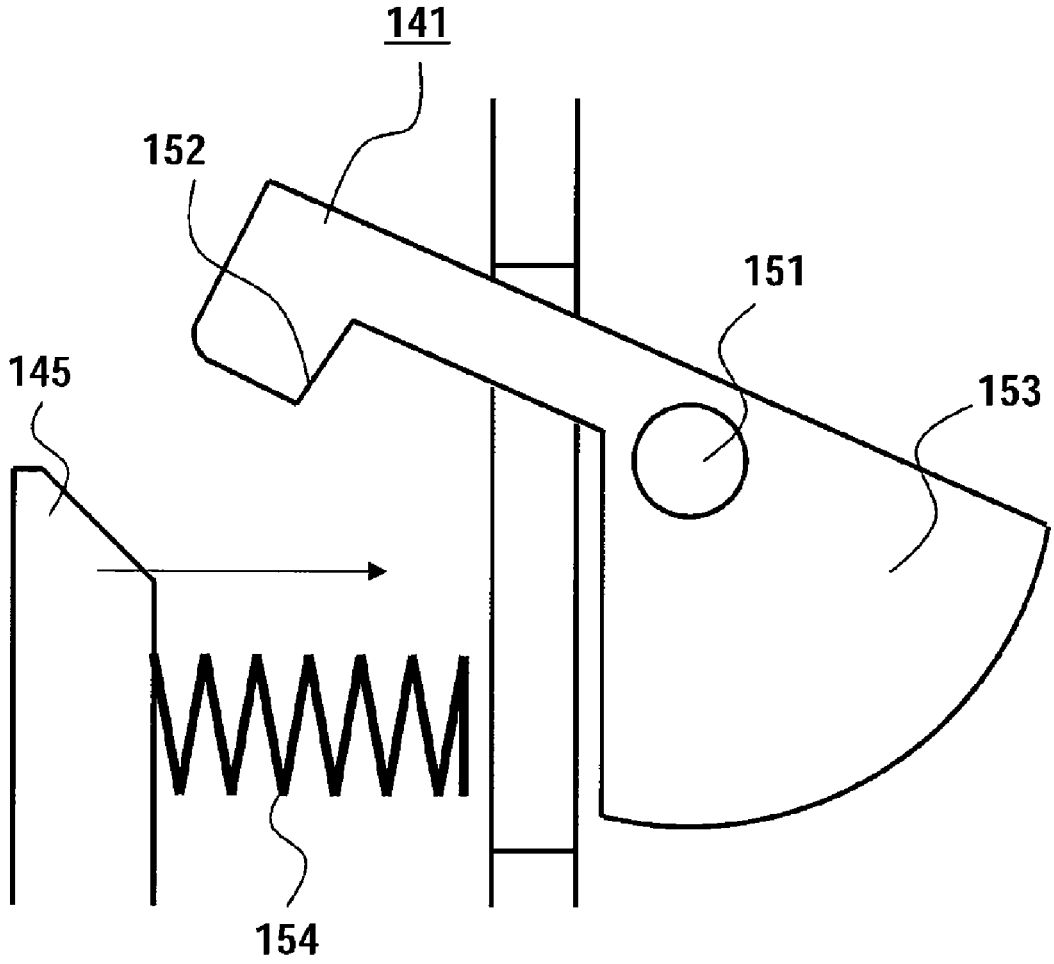
FIG. 16 is a drawing of a stopper and a connector viewed from the front side.

FIG. 16 is a drawing of the stopper 141 and the connector 145 when viewed from the front. The stopper 141 rotates about a shaft 151. The stopper 141 is provided with an engaging claw 152 on the left side with respect to the shaft 151 and a balancer 153 on the right side with respect to the shaft 151. The balancer 153 is heavier than the engaging claw 152, and the center of gravity of the stopper 141 is located on the right side with respect to the shaft 151, so that the stopper 141 tries to rotate clockwise in FIG. 16. The connector 145 supports a spring 154 on the right side thereof. The spring 154 may be supported on the left side of the balancer 153 instead of the right side of the connector 145.

Figure 17:
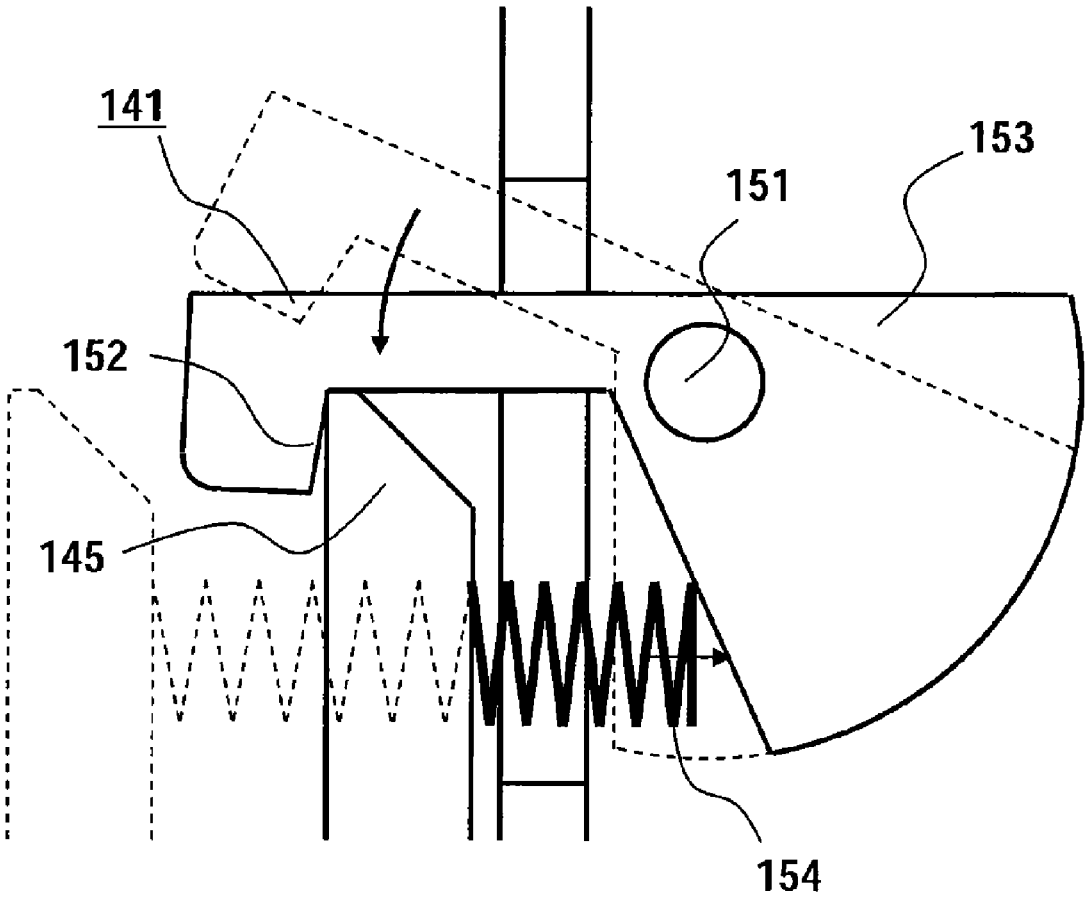
FIG. 17 is a drawing of the connector engaged with the stopper viewed from the front side.

FIG. 17 is a drawing of the stopper 141 and the connector 145 when viewed from the front. If the connector 145 moves rightward and approaches the stopper 141, the spring 154 comes into abutment with the balancer 153 below the shaft 151. If the connector 145 moves further rightward, the spring 154 presses the balancer 153 to rotate the stopper 141, and causes the engaging claw 152 to move downward. If the connector 145 moves further rightward, the spring 154 is contracted and maintains a force to press the balancer 153, while the engaging claw 152 engages the connector 145.

Figure 18:
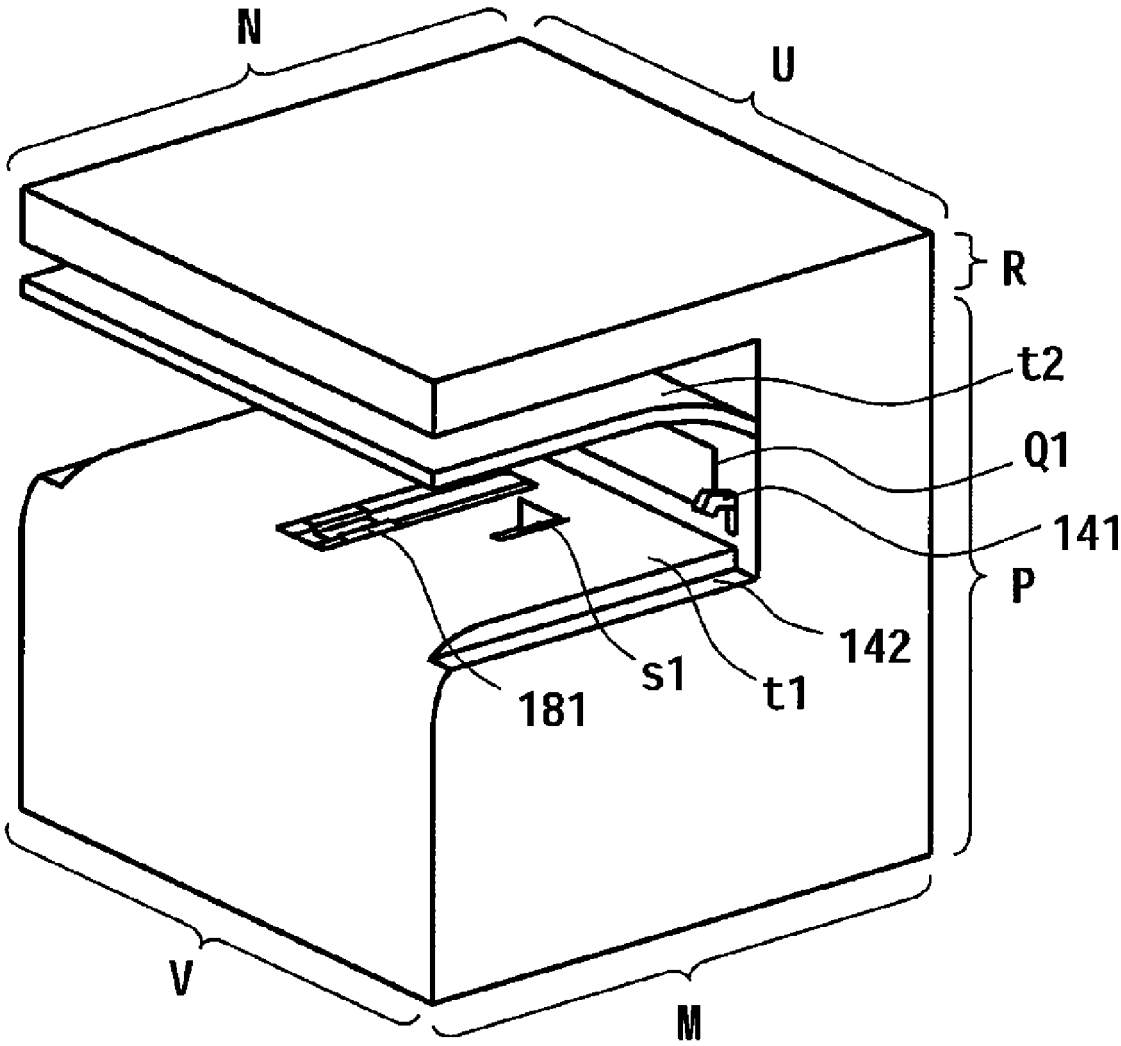
FIG. 18 is a perspective view of the image forming apparatus from which the holding unit and a supporting frame are removed.

FIG. 18 is a perspective view of the image forming apparatus from which the holding unit H and the supporting frame 143 are removed. The first discharge tray t1 includes a moving mechanism 181 at a center in the direction from the front side to the rear side for engaging the supporting frame 143 to move the supporting frame 143 rightward and leftward. The sensor S1 detects the presence or absence of the sheet in the holding unit H by passing through a slit of the holding unit H. If the holding unit H assumes the standing position, the sensor S1 detects the presence or absence of the sheet on the first discharge tray t1. A left end of the first discharge tray t1 is rounded in vertical cross section for allowing the holding unit H to rotate smoothly between the standing position and the face-up position in association with the rightward and leftward sliding movement of the supporting frame 143.

Figure 19:
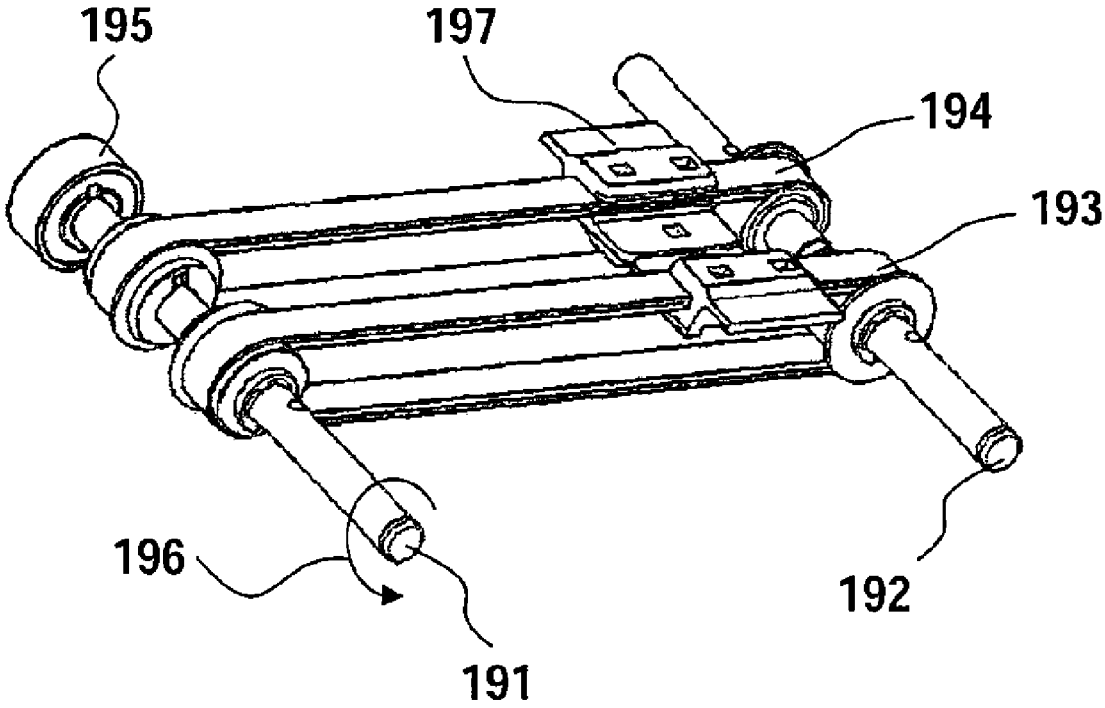
FIG. 19 is a perspective view of a moving mechanism.

FIG. 19 is a perspective view of the moving mechanism 181. The moving mechanism 181 is provided with a left shaft 191 and a right shaft 192 inside a front-side belt 193 and a rear-side belt 194. A reel 195 applies an urging moment in the direction indicated by an arrow 196 on the left shaft 191. The urging moment of the left shaft 191 moves upper sides of the front-side belt 193 and the rear-side belt 194 leftward. The right shaft 192 is driven by the front-side belt 193 and the rear-side belt 194 to rotate. An attachment 197 engaging the supporting frame 143 grips the upper sides of the front-side belt 193 and the rear-side belt 194. The attachment 197 moves together with the upper sides of the front-side belt 193 and the rear-side belt 194.

If the stoppers 141 engage the connectors 145, the moving mechanism 181 urges the supporting frame 143 leftward. When the stoppers 141 are disengaged from the connectors 145, the moving mechanism 181 moves the supporting frame 143 leftward and causes the holding unit H to assume the standing position. In order to cause the holding unit H to assume the face-up position, a lower portion of the holding unit H in the standing position is lifted manually and the supporting frame 143 is moved rightward to engage the connectors 145 with the stoppers 141.

In one aspect of the present invention, the invention comprises engaging the connectors 145 with the stoppers 141 by rotating the reel 195 with a motor and moving the supporting frame 143 rightward automatically.

Figure 20:
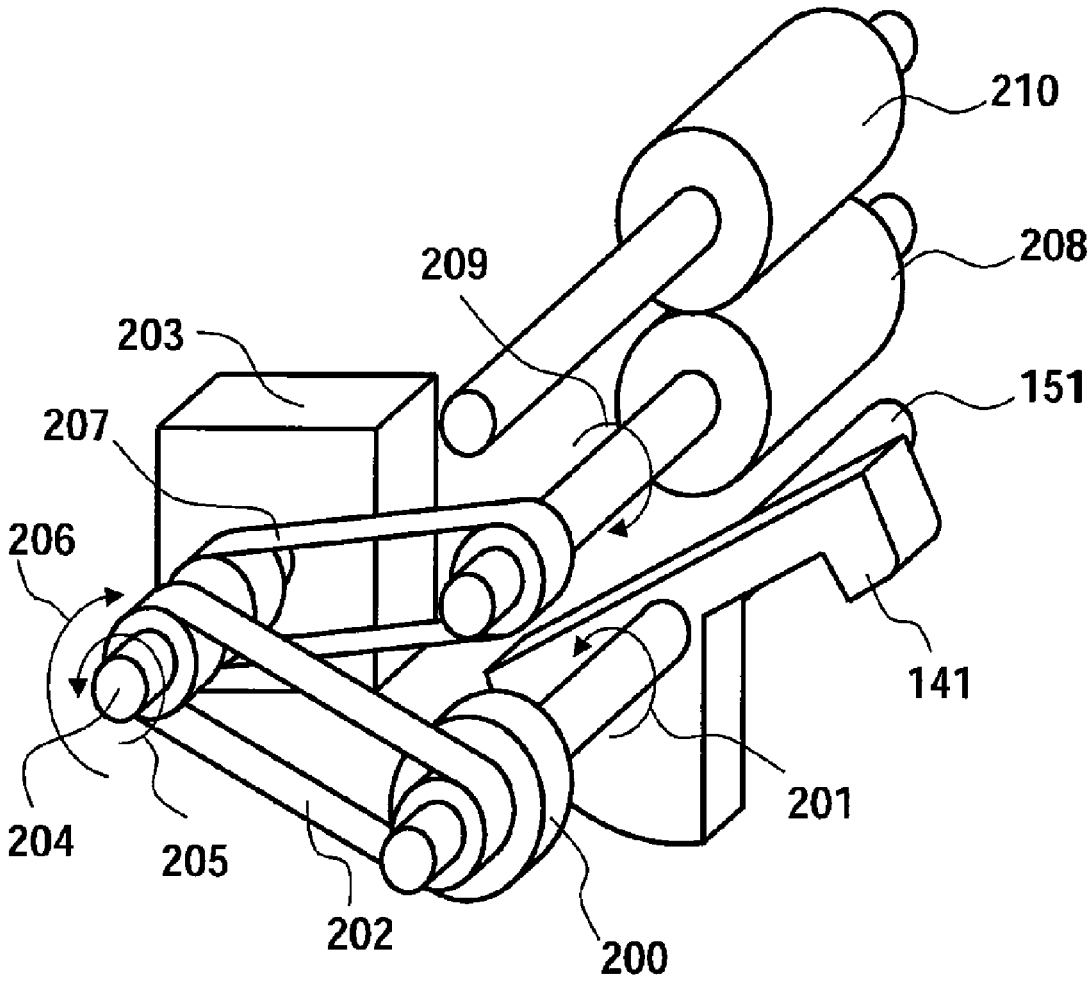
FIG. 20 is a perspective view of a rear-side stopper viewed from the rear side.

FIG. 20 is a perspective view of the rear-side stopper 141 viewed from the rear side. A one-way clutch 200 transmits a torque to rotate the shaft 151 in the direction of an arrow 201, which is counterclockwise direction in FIG. 20, and does not transmit a torque in the opposite direction from the arrow 201. A belt 202 transmits rotations of a rotating shaft 204 of a motor 203 to the one-way clutch 200. The motor 203 rotates the rotating shaft 204 in the direction of an arrow 205, which is the counterclockwise direction in FIG. 20, when disengaging the stopper 141 from the connector 145, and rotates the same in the direction of an arrow 206, which is the clockwise direction in FIG. 20, when carrying the sheet. A belt 207 transmits the rotation of the rotating shaft 204 to a lower-side discharge roller 208. The lower-side discharge roller 208 rotates in the direction indicated by an arrow 209, which is the clockwise direction in FIG. 20. An upper-side discharge roller 210 is driven by the lower-side discharge roller 208.

There may be provided a one-way clutch between the belt 207 and the lower-side discharge roller 208 so as to prevent transmission of the counterclockwise torque, which is the opposite direction from the direction indicated by the arrow 209 in FIG. 20.

Figure 21:
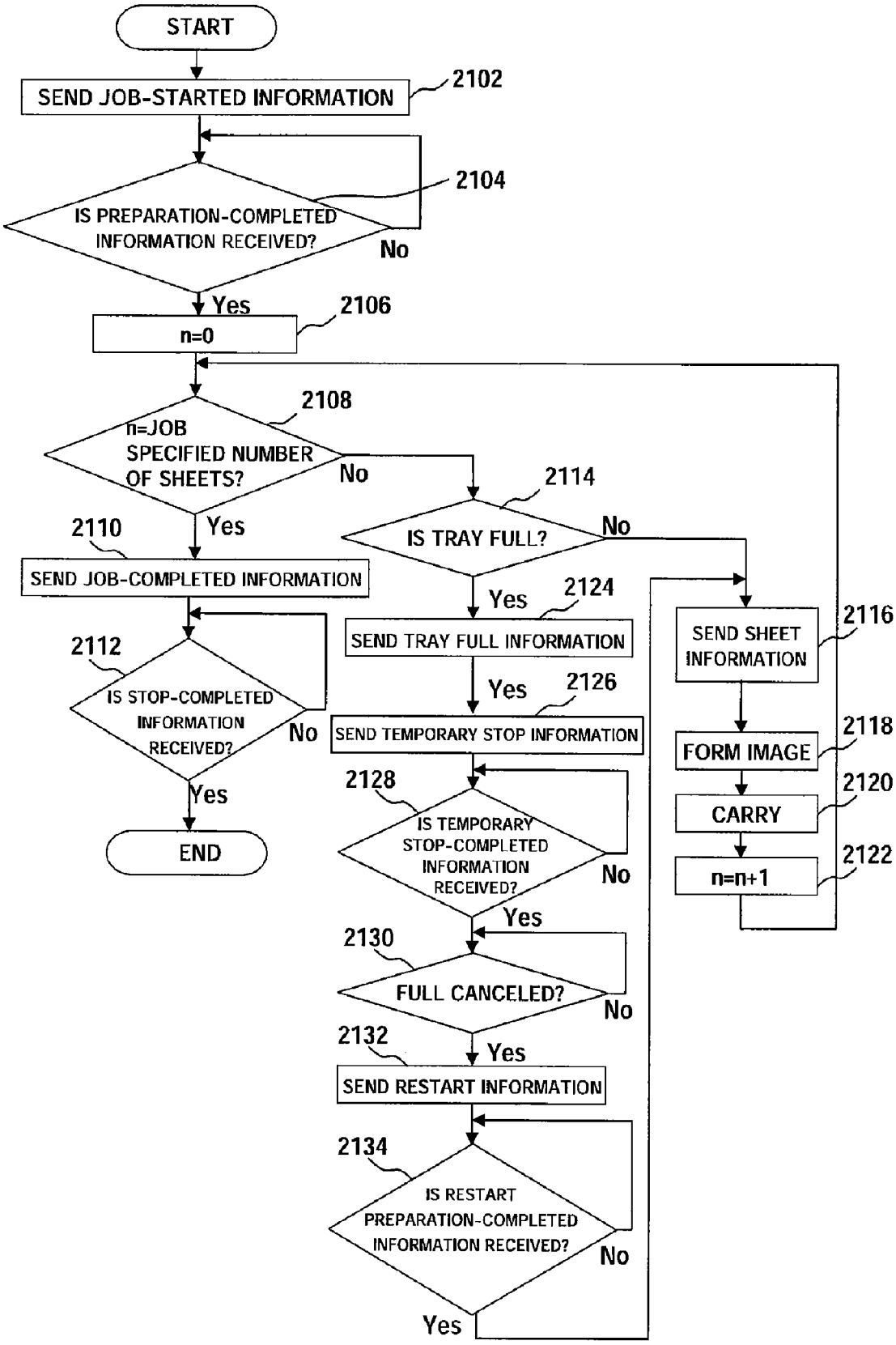
FIG. 21 is a flowchart relating to an operation of a CPU.

In order to explain the movement of the holding unit H, an operation of the CPU 801 will be described. FIG. 21 is a flowchart relating to the operation of the CPU 801.

When the image forming apparatus starts the execution of the printing job, the CPU 801 sends job-started information to the post-processing unit F in Act 2102. In Act 2104, the CPU 801 waits until the CPU 801 receives preparation-completed information from the post-processing unit F (No in Act 2104). When the CPU 801 receives the preparation-completed information from the post-processing unit F (Yes in Act 2104) the CPU 801 initializes a variable n to zero in Act 2106.

In Act 2108, the CPU 801 checks the variable n to recognize whether the image forming unit P already printed the number of sheets specified by the printing job. If the variable n reaches the specified number (Yes in Act 2108), the CPU 801 sends job-completed information to the post-processing unit F in Act 2110. In Act 2112, the CPU 801 waits until the CPU 801 receives stop-completed information from the post-processing unit F (No in Act 2112). When the CPU 801 receives the stop-completed information from the post-processing unit F (Yes in Act 2112), the execution of the printing job is ended.

If the variable n does not reach the specified number of sheets in Act 2108 (No in Act 2108), the CPU 801 checks whether or not the holding unit H or the first discharge tray t1 is full in Act 2114. The CPU 801 determines that the holding unit H or the first discharge tray t1 is full when the number of sheets delivered to the post-processing unit F after the sensor S1 detects the presence of the sheets before the sensor S1 detects the absence of the sheet reaches or exceeds a threshold value which indicates that the holding unit H or the first discharge tray t1 is full.

If the first discharge tray t1 is not full (No in Act 2114), the CPU 801 sends size information of the sheet to be subjecting to print to the post-processing unit F in Act 2116. In Act 2118, the CPU 801 causes the image forming unit P to print on the sheet. In Act 2120, the CPU 801 causes the sheet printed by the image forming unit P to be carried to the post-processing unit F and, when the sheet is delivered to the post-processing unit F, increments the variable n by one in Act 2122, and then executes Act 2108 again.

If the first discharge tray t1 is full (Yes in Act 2114), the CPU 801 notifies the post-processing unit F the fact that the first discharge tray t1 is full in Act 2124. The CPU 801 notifies the post-processing unit F that the job is stopped temporarily in Act 2126. The CPU 801 waits until the CPU 801 is notified by the post-processing unit F that the post-processing unit F is temporarily stopped in Act 2128 (No in Act 2128). When the CPU 801 is notified that the post-processing unit F is brought into the temporarily stopped state from the post-processing unit F (Yes in Act 2128), the CPU 801 checks whether or not the full in the holding unit H or the first discharge tray t1 is cancelled in Act 2130. The CPU 801 determines that the full in the holding unit H or the first discharge tray t1 is cancelled when the sensor S1 detects the absence of the sheet after the determination of the full in the holding unit H or the first discharge tray t1.

In Act 2130, the CPU 801 waits until the full in the holding unit H or the first discharge tray t1 is cancelled (No in Act 2130). When the full in the holding unit H or the first discharge tray t1 is cancelled (Yes in Act 2130), the CPU 801 notifies the post-processing unit F the restart of the job in Act 2132. In Act 2134, the CPU 801 waits until the CPU 801 is notified by the post-processing unit F that the post-processing unit F is ready to restart (No in Act 2134). The CPU 801 executes Act 2116 when notified that the post-processing unit F is ready to restart (Yes in Act 2134).

Figure 22:
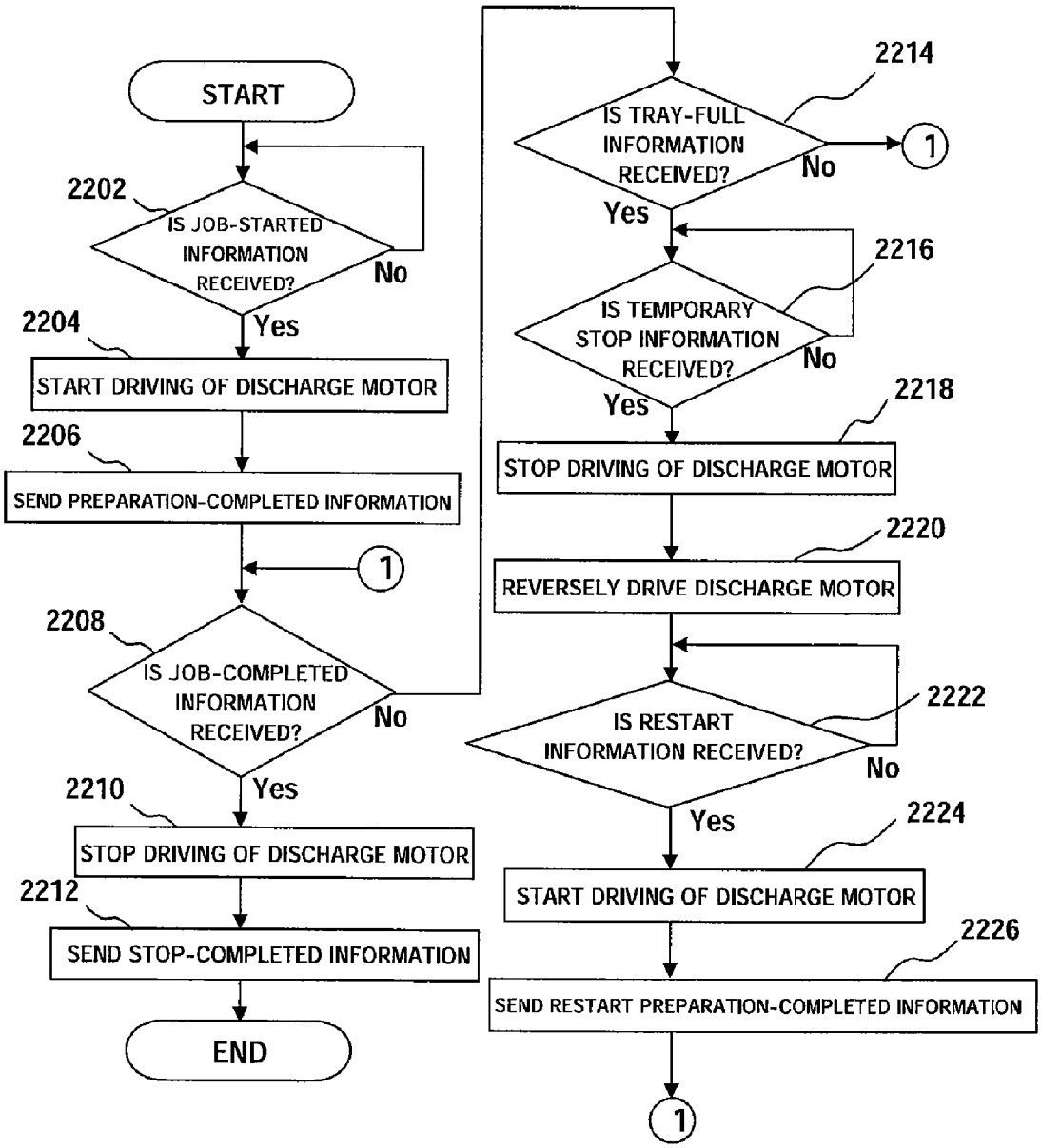
FIG. 22 is a flowchart relating to an operation of a job information acquiring unit.

The movement of the holding unit H will be described. FIG. 22 is a flowchart relating to an action of the job information acquiring unit 101.

When the image forming apparatus starts the printing job, the job information acquiring unit 101 waits until the job information acquiring unit 101 is notified by the CPU 801 the fact that the execution of the printing job is started in Act 2202 (No in Act 2202). When the job information acquiring unit 101 is notified by the CPU 801 the fact that the printing job is started (Yes in Act 2202), the job information acquiring unit 101 causes the movement control unit 105 to start driving the discharge roller 805 in Act 2204. The direction to drive the discharge roller 805 is the direction indicated by the arrow 209 in FIG. 20.

In Act 2206, the job information acquiring unit 101 sends the preparation-completed information to the CPU 801. In Act 2208, the job information acquiring unit 101 checks whether the job-completed information is received from the CPU 801. The job information acquiring unit 101 executes Act 2208 every time when the job information acquiring unit 101 receives the sheet from the image forming unit P. Upon reception of the job-completed information from CPU 801 (Yes in Act 2208), the job information acquiring unit 101 causes the movement control unit 105 to stop the discharge roller 805 in Act 2210, and the job information acquiring unit 101 sends the stop-completed information to the CPU 801 in Act 2212 to end the action.

If the job information acquiring unit 101 does not receive the job-completed information from the CPU 801 yet (No in Act 2208), the job information acquiring unit 101 checks whether the fact that the first discharge tray t1 is full is notified by the CPU 801 in Act 2214. If the fact that the first discharge tray t1 is full is not notified by the CPU 801 (No in Act 2214), the job information acquiring unit 101 executes Act 2208 upon reception of the next sheet from the image forming unit P.

If the fact that the first discharge tray t1 is full is notified by the CPU 801 (Yes in Act 2214), the job information acquiring unit 101 waits until the job information acquiring unit 101 receives that the job will be temporarily stopped from the CPU 801 (No in Act 2216). When the job information acquiring unit 101 is notified by the CPU 801 that the job will be stopped temporarily in Act 2216 (Yes in Act 2216), the job information acquiring unit 101 causes the movement control unit 105 to stop driving of the discharge roller 805 in Act 2218. The job information acquiring unit 101 causes the movement control unit 105 to drive the discharge roller 805 in the opposite direction in Act 2220. The amount of drive of the discharge roller 805 in the opposite direction may be an extent which is able to disengage the stoppers 141 from the connectors 145.

The job information acquiring unit 101 waits until the job information acquiring unit 101 is notified by the CPU 801 that the job will be restarted in Act 2222 (No in Act 2222). In Act 2224, the job information acquiring unit 101 causes the movement control unit 105 to start driving the discharge roller 805. The direction to drive the discharge roller 805 is the direction indicated by the arrow 209 in FIG. 20.

The job information acquiring unit 101 notifies the CPU 801 that the post-processing unit F is ready to restart in Act 2226, and executes Act 2208 again upon reception of the next sheet from the image forming unit P.

Sixth Embodiment

Figure 23:
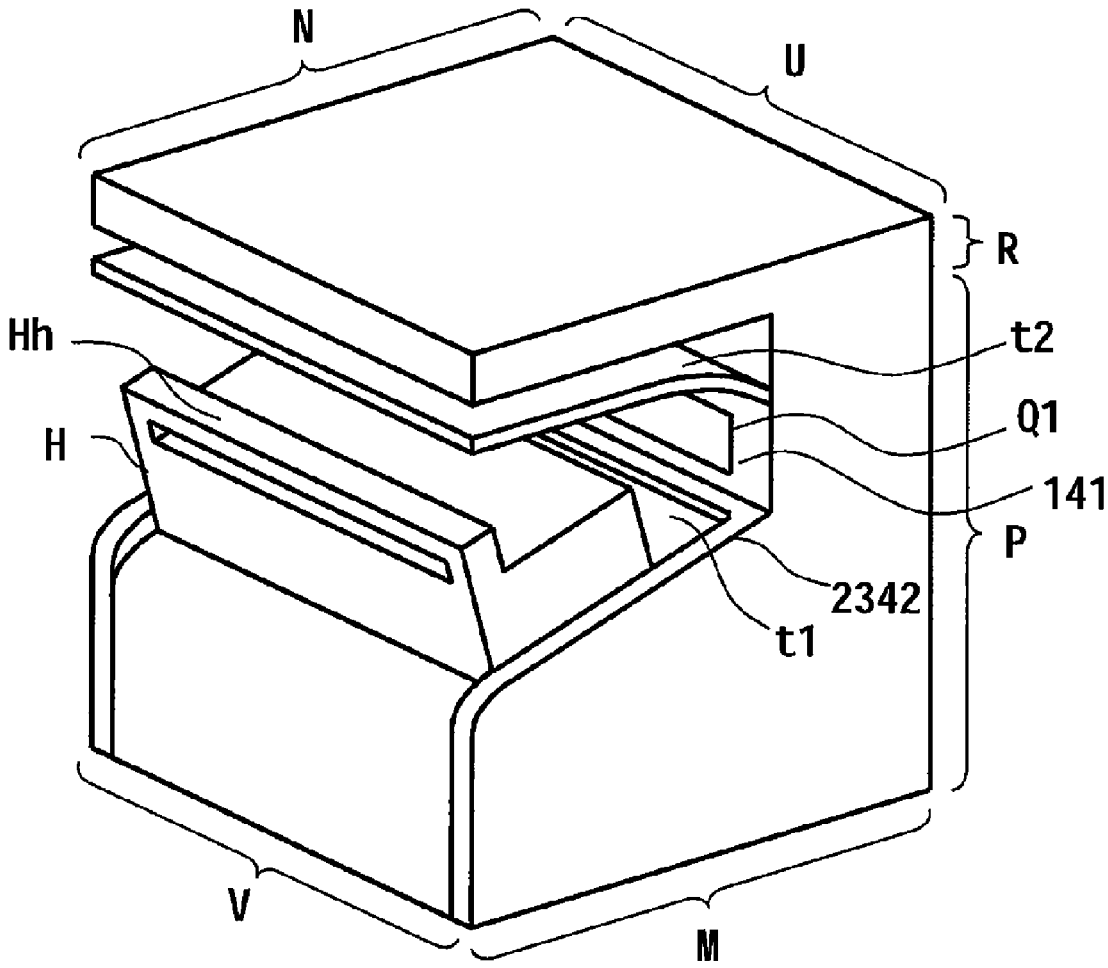
FIG. 23 is a perspective view of the image forming apparatus according to a sixth embodiment in which the holding unit is in a face-up position.

FIG. 23 is a perspective view of the image forming apparatus in which the holding unit H is in the face-up position. The image forming unit P includes the first discharge tray t1 on the upper surface thereof. The first discharge tray t1 is inclined with respect to the horizontal direction so that the left side is lower. The image forming unit P includes the discharge port Q1 on the upper right of the first discharging tray t1. The image forming unit P includes guides 2342 respectively on the front side and the rear side of the first discharge tray t1.

The holding unit H slides right upward and left downward on the first discharge tray t1 along the both guides 2342 between the both guides 2342. The holding unit H assumes the face-up position when the holding unit H is on the first discharge tray t1. The face-up position of the holding unit H in the sixth embodiment is a posture inclined along the first discharge tray t1.

Figure 24:
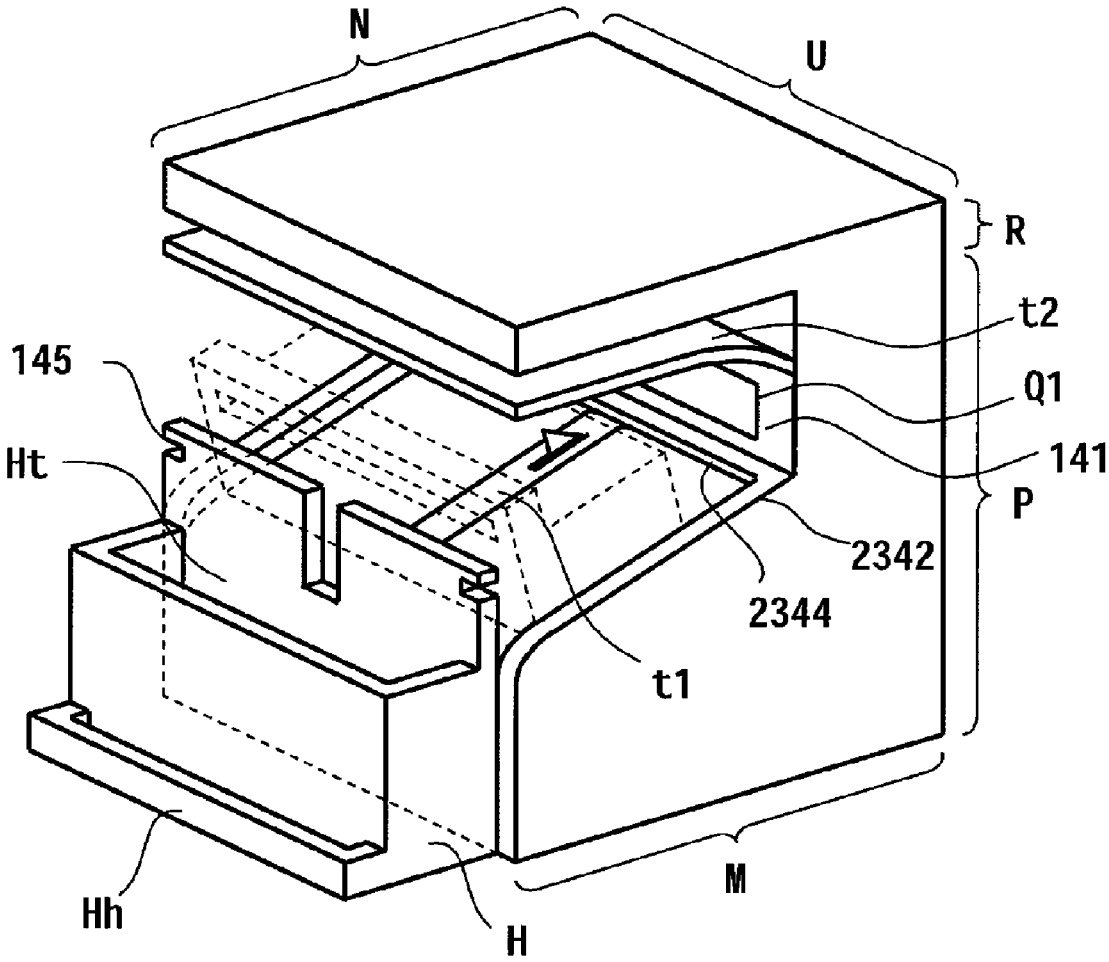
FIG. 24 is a perspective view of the image forming apparatus in which the holding unit is in a standing position.

FIG. 24 is a perspective view of the image forming apparatus in which the holding unit H is in the standing position. When the holding unit H moves left downward, the holding unit H is no longer supported by the first discharge tray t1 and hence rotates downward and then assumes the standing position. In the standing position, the sheet receiver Ht may be oriented vertically, but may be oriented between 45 degrees and 90 degrees inclusive with respect to the horizontal direction. The left end of the first discharge tray t1 is rounded in vertical cross section for allowing the holding unit H to rotate smoothly between the standing position and the face-up position.

The connectors 145 are provided on an upper end of the sheet receiver Ht of the holding unit H in the standing position. The holding unit H includes a handle Hh for moving the holding unit H from the standing position to the face-up position manually. The handle Hh is provided at a lower end on the left side of the holding unit H in the standing position so as to prevent the hand from interfering with the image scanning unit R too much when moving the holding unit H from the standing position to the face-up position manually. A slit 2344 is provided on an upper right extension of the first discharge tray t1 and below the discharge port Q1.

Figure 25:
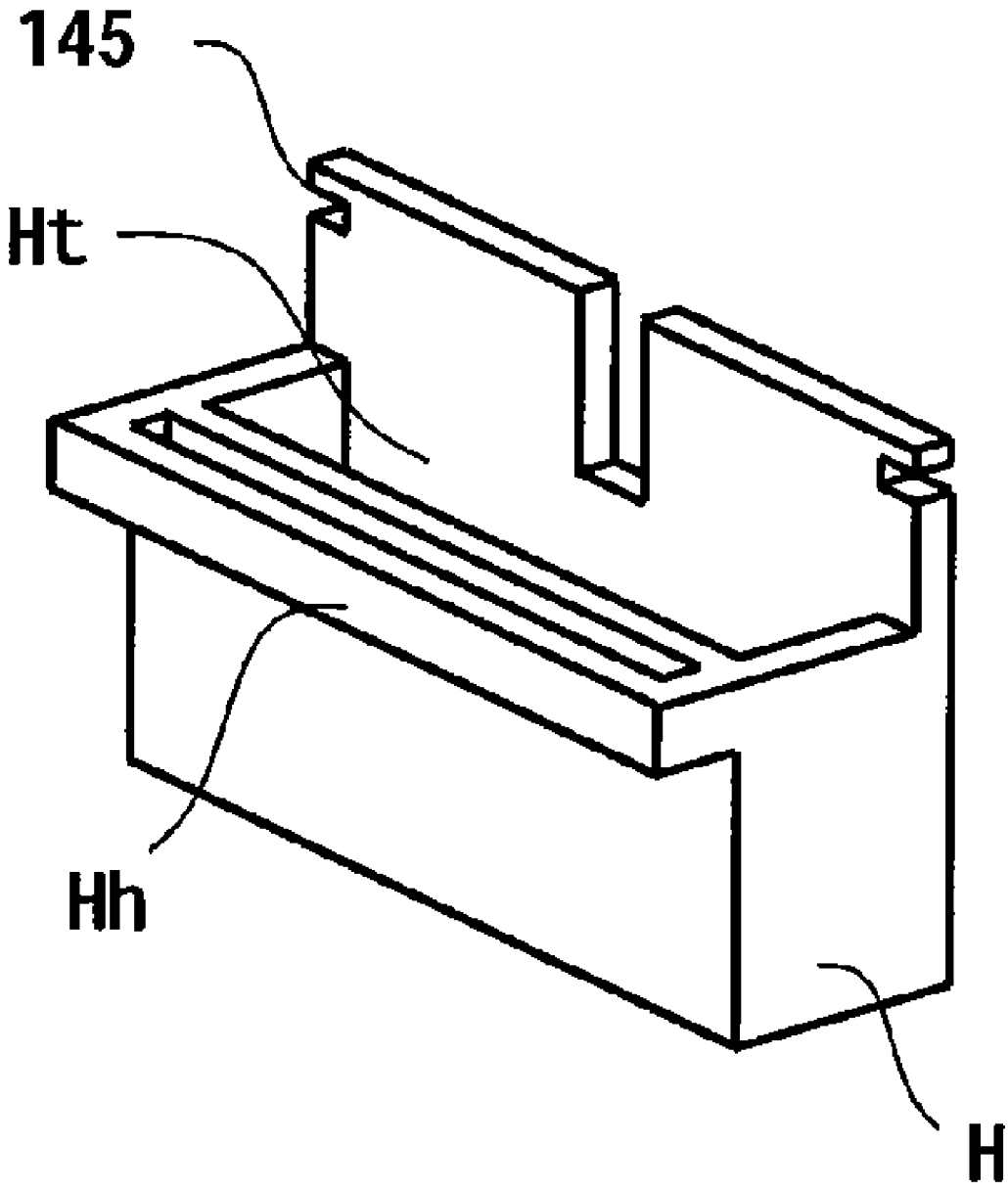
FIG. 25 is a perspective view of a modification of the holding unit.

FIG. 25 is a perspective view of a modification of the holding unit H. The handle Hh may be provided at a position upward of the lower end on the left side of the holding unit H in the standing position so as to allow the user to operate at a high position without bending over when moving the same from the standing position to the face-up position manually. The handle Hh may be provided at an upper end on the left side of the holding unit H in the standing position.

Figure 26:
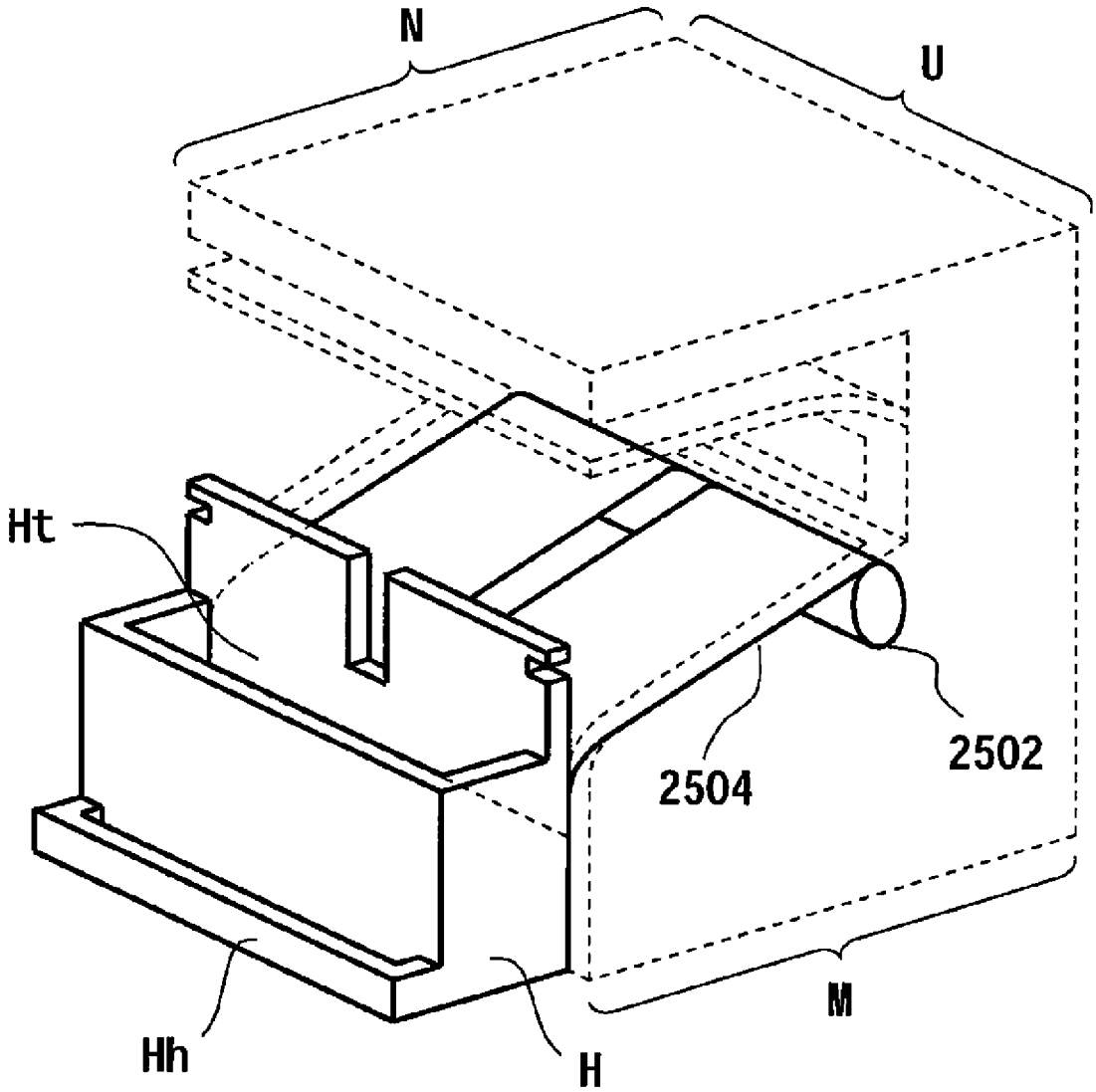
FIG. 26 is a perspective view of the image forming apparatus in which the holding unit is in the standing position.

FIG. 26 is a perspective view of the image forming apparatus in which the holding unit H is in the standing position. A reel 2502 is provided at a position below a right upper end of the first discharge tray t1. In order to wind a belt 2504 when the holding unit H moves from the standing position to the face-up position, the reel 2502 is urged to wind the belt 2504 to the upper right end of the first discharge tray t1. A lower left end of the belt 2504 supports the right side of the holding unit H. The belt 2504 is provided between the both guides 2342. The sheet discharged from the discharge port Q1 when the holding unit H is in the standing position slips downward on the belt 2504. The right side of the sheet receiver Ht stops the sheet sliding on the belt 2504. A configuration in which a motor drives the reel 2502 so as to wind the belt 2504 toward the upper right end of the first discharge tray t1 is also applicable.

Figure 27:
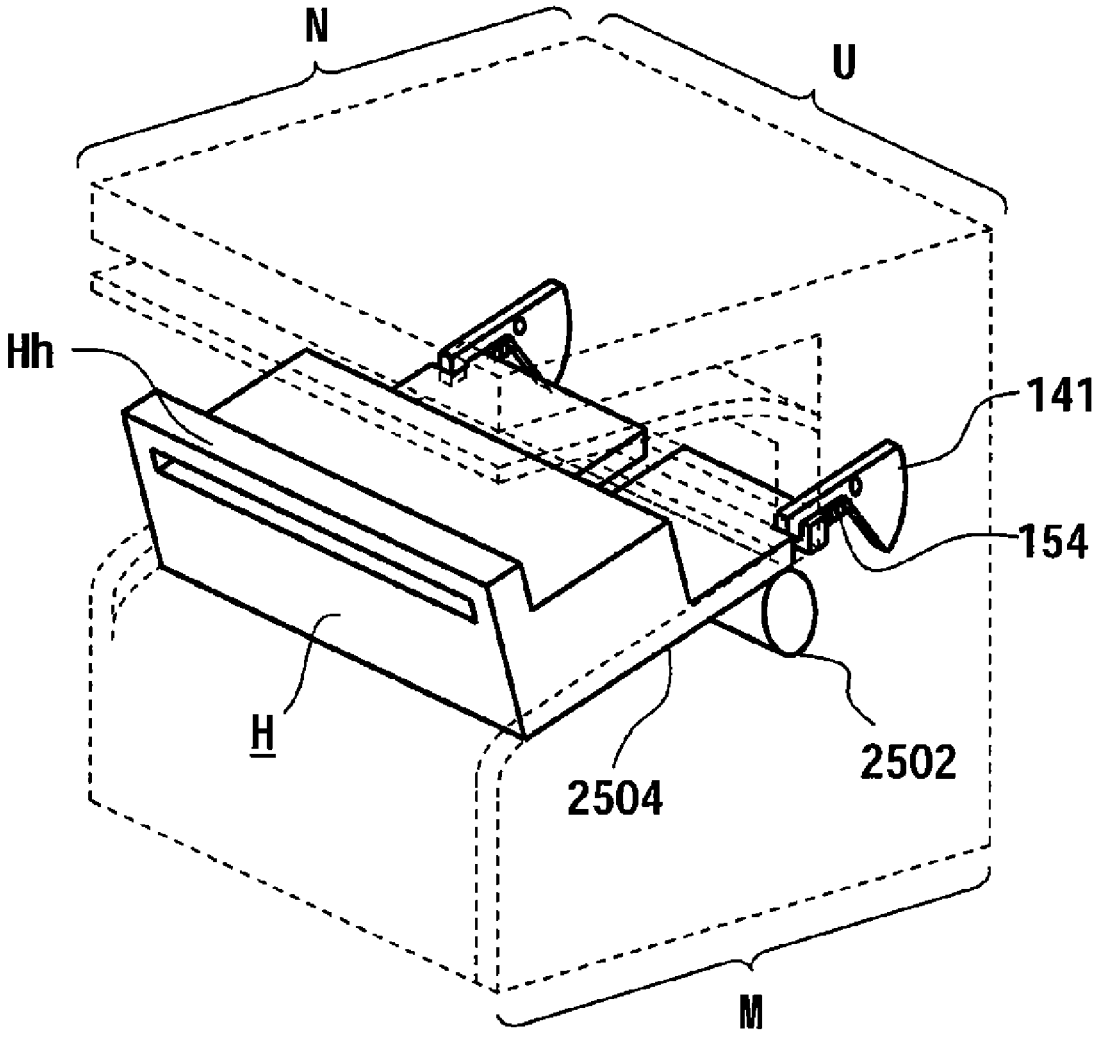
FIG. 27 is a perspective view of the image forming apparatus in which the holding unit is in the face-up position.

FIG. 27 is a perspective view of the image forming apparatus in which the holding unit H is in the face-up position. The upper end of the sheet receiver Ht enters the slit 2344 provided on the upper right extension of the first discharge tray t1 and below the discharge port Q1. The stoppers 141 are provided at an upper right in the slit 2344. The stoppers 141 engage the connectors 145. When the stoppers 141 disengage the connectors 145, the holding unit H moves lower leftward against an urging force of the reel 2502 by its own weight.

Seventh Embodiment

Subsequently, a seventh embodiment will be described.

Figure 28:
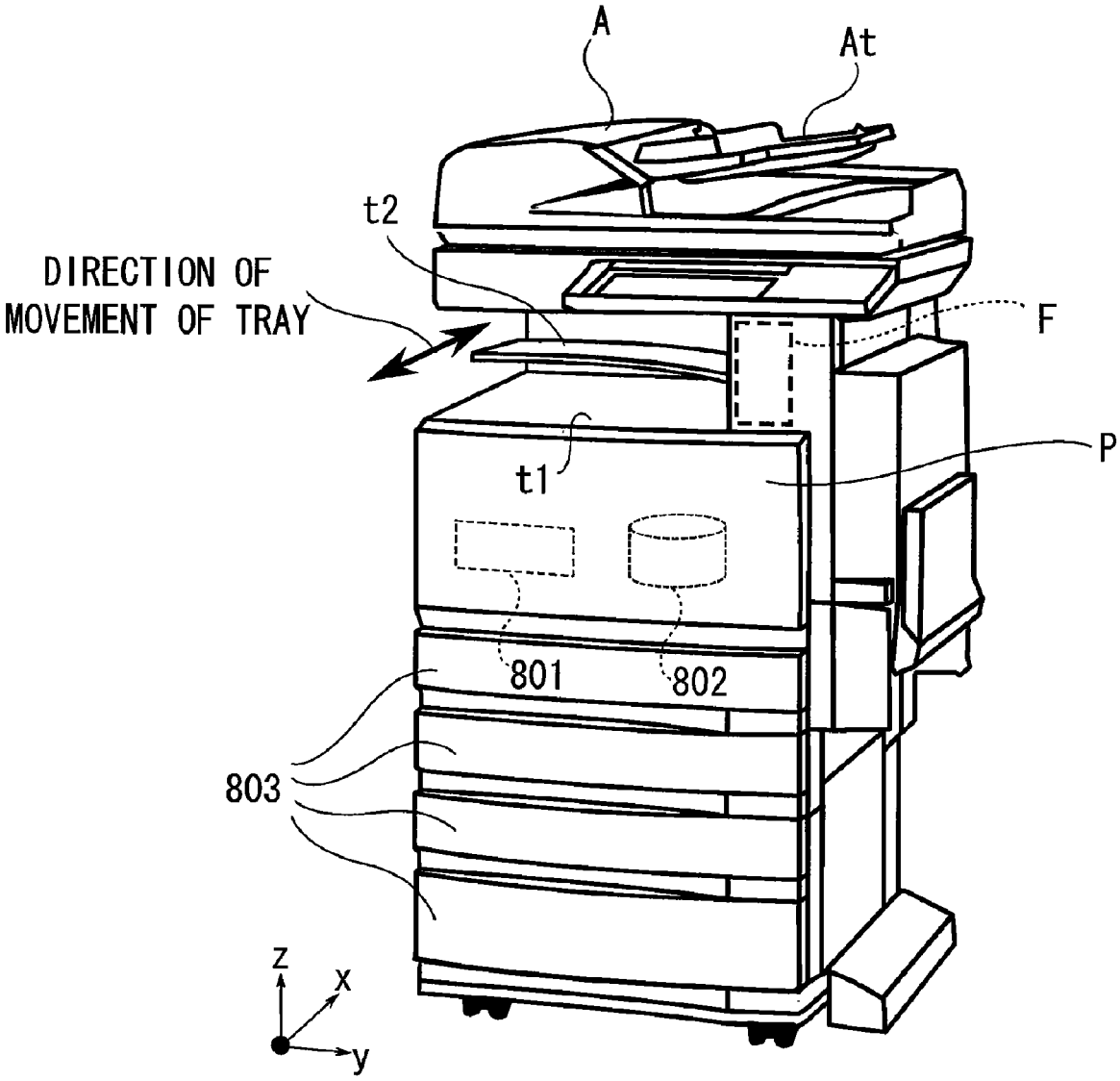
FIG. 28 is a perspective view of the image forming apparatus according to a seventh embodiment.

FIG. 28 is a perspective view of the image forming apparatus according to the seventh embodiment.

As shown in the same drawing, in the above image forming apparatus, the second discharge tray t2 is movable in the X-axis direction in the same drawing.

Figure 29:
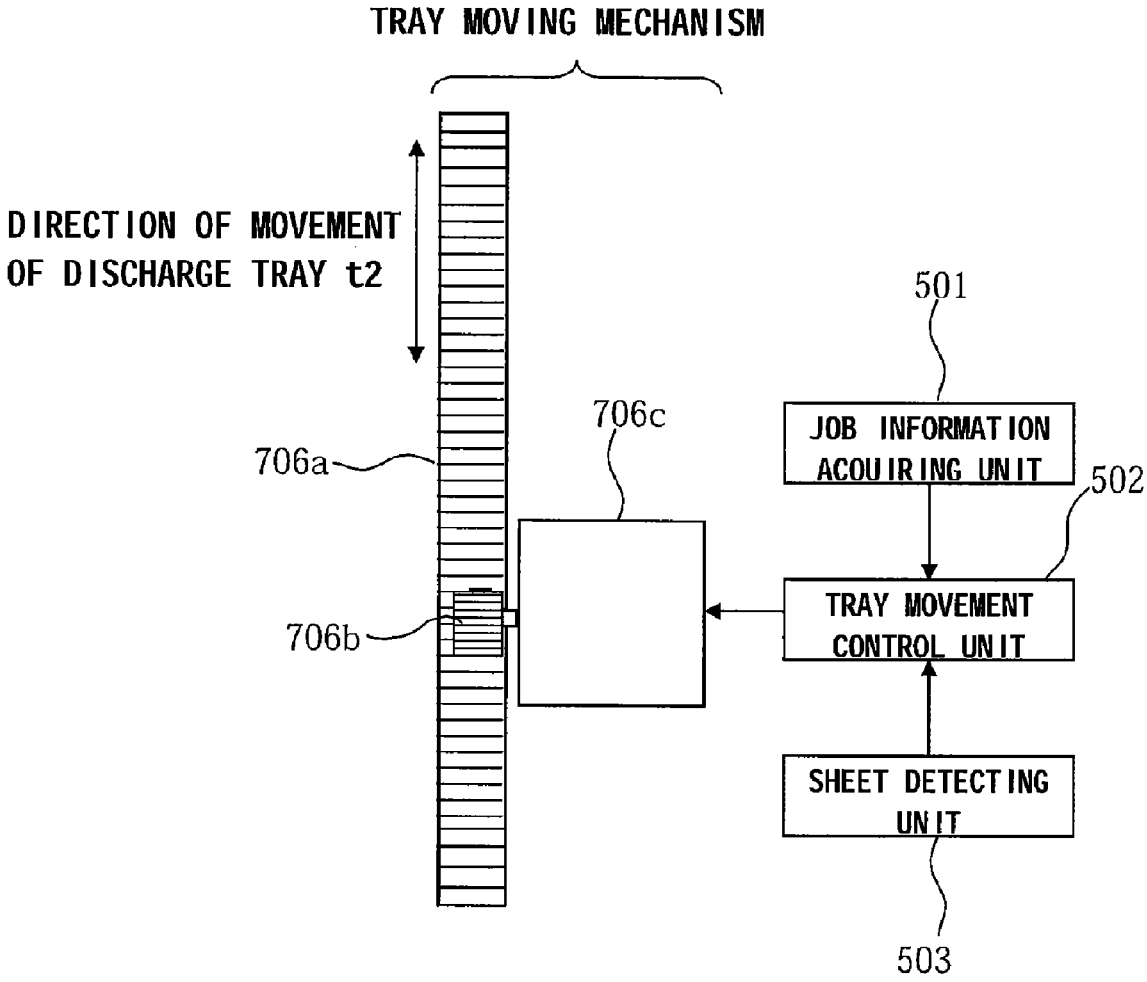
FIG. 29 is a detailed and functional block of a tray moving mechanism for moving a second discharge tray t2 in the image forming apparatus according to the seventh embodiment.

FIG. 29 is a detailed and functional block of a tray moving mechanism for moving the second discharge tray t2 in the image forming apparatus according to the seventh embodiment.

As shown in the same drawing, the tray moving mechanism includes a rack 706*a*, a pinion 706*b*, and a motor 706*c*. The tray moving mechanism in the above configuration moves the second discharge tray t2 in the horizontal direction orthogonal to the sheet discharging direction from a discharge port Q2 (the X-axis direction in FIG. 28).

The image forming apparatus includes a job information acquiring unit 501, a tray movement control unit 502, and a sheet detecting unit 503.

The job information acquiring unit 501 acquires information relating to the state of execution of the printing job in the image forming apparatus from, for example, the CPU 801.

Figure 30:
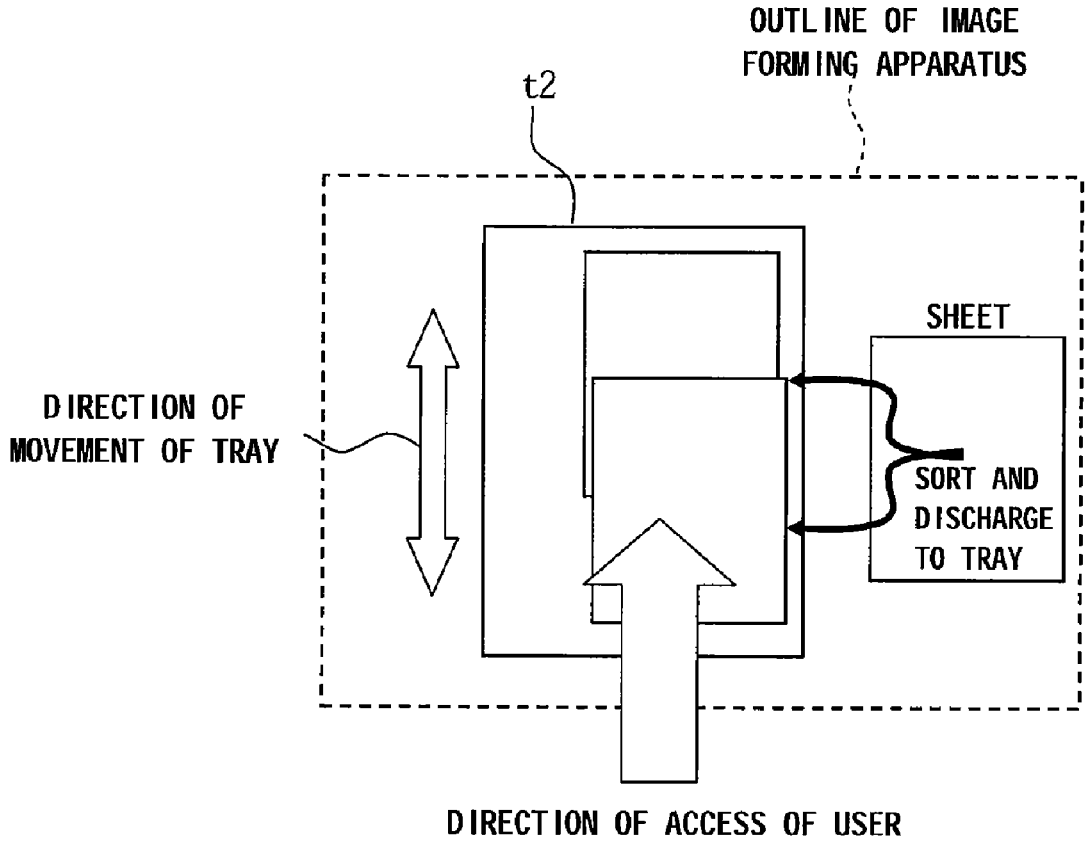
FIG. 30 is a drawing showing sorting sheets on the second discharge tray t2.

The tray movement control unit 502 controls the movement of the second discharge tray t2 by the tray moving mechanism to sort the sheets discharged from the discharge port Q2 on the second discharge tray t2 (see FIG. 30).

Specifically, when the execution of the job by the image forming apparatus is completed on the basis of the information acquired by the job information acquiring unit 501 from the CPU 801 or the like, the tray movement control unit 502 moves the second discharge tray t2 toward the near side of the apparatus (near side in the X-axis direction) (third position) with respect to the range of movement (from a first position to a second position) during the sorting action.

When the execution of the job by the image forming apparatus is completed, the tray movement control unit 502 moves the second discharge tray t2 to the near side of the apparatus with respect to the range of movement during the sorting action, and then moves the same to a predetermined waiting position above the first discharge tray t1 after a lapse of a predetermined time period (after a lapse of 60 seconds, for example).

The sheet detecting unit 503 has a role to detect the presence or absence of the sheet placed on the second discharge tray t2.

When the execution of the job by the image forming apparatus is completed, the tray movement control unit 502 moves the second discharge tray t2 to the near side of the apparatus with respect to the range of movement during the sorting action. Then, when the sheet is no longer detected by the sheet detecting unit 503, (that is, after the removal of the sheet by the user), the tray movement control unit 502 moves the same to the predetermined waiting position above the first discharge tray t1.

Figure 31:
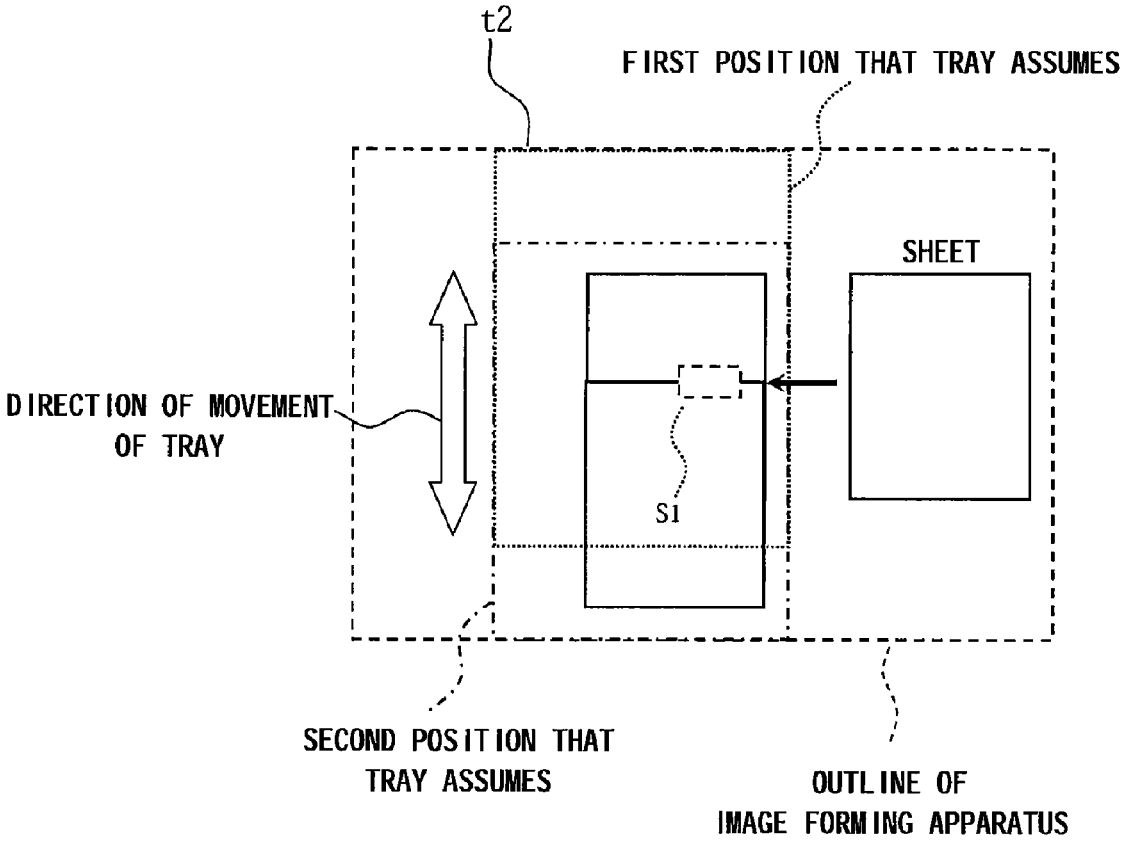
FIG. 31 is a drawing of a range of movement of the second discharge tray t2 during sorting.

The tray movement control unit 502 controls the movement of the second discharge tray t2 so that the range of movement of the second discharge tray t2 during the sorting action falls within a range (footprint) right below the image scanning unit R (see FIG. 31).

As mentioned above, by controlling the movement of the second discharge tray t2 to prevent the second discharge tray t2 and the sheet on the second discharge tray t2 from protruding from the footprint of the image scanning unit R during the sorting action of the second discharge tray t2, the interference between the second discharge tray t2 during the sorting action and things located around the apparatus or the user is avoided.

Figure 32:
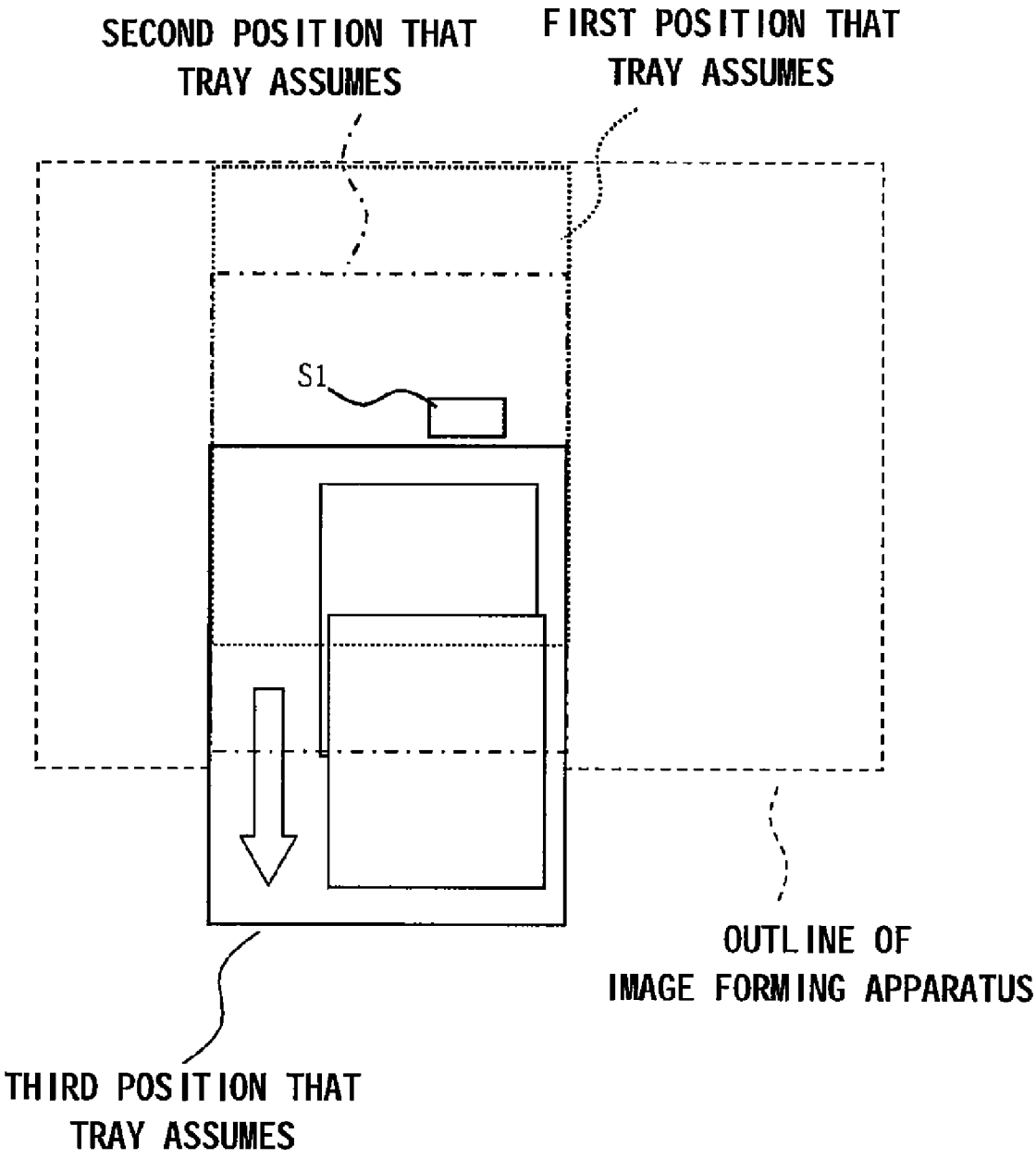
FIG. 32 is a drawing showing a state in which the second discharge tray t2 protrudes outward from the image forming apparatus after the job is ended.

The tray movement control unit 502 may move the second discharge tray t2 to a position protruding out from the image forming apparatus (outside of the footprint of the image scanning unit) after the job by the image forming apparatus is ended (see FIG. 32).

As mentioned in the above configuration, even when the plurality of discharge trays are provided in the body in the image forming apparatus of the in-body paper discharging type, since the second discharge tray t2 having the sheets after the process placed thereon moves toward the near side of the apparatus, the user is allowed to access the sheets after the process easily, which provides a good operability.

In particular, when the sorting of the sheets is performed by shifting the position in the direction orthogonal to the sheet discharging direction, an event such that the user cannot take the sheets sorted to the inside of the apparatus viewed from the near side thereof on the second discharge tray t2 easily may be avoided.

The respective actions in the process performed by the image forming apparatus in the respective embodiments described above are realized by causing the CPU 801 to execute a discharged sheet management program stored in the storage unit 802.

In addition, a program to cause a computer which constitutes the image forming apparatus to execute the respective actions described above is provided as the discharged sheet management program. In the embodiment, a case in which the program is stored in advance in the storage area provided in the interior of the apparatus is described. However, the invention is not limited thereto, and a similar program may be downloaded to the apparatus through a network, or the similar program stored in a computer readable recording medium may be installed in the apparatus. The recording medium may be of any type as long as the recording medium allows storage of the program and allows the computer to read the same therefrom. Specifically, as the recording medium, for example, internal storage devices which are mounted in the interior of the computer such as a ROM or a RAM, portable recording media such as CD-ROMs, flexible discs, DVD discs, magneto-optic disks, IC cards, databases which contain computer programs, or other computers and databases thereof, and communication media on lines are exemplified. Alternatively, the functions obtained by installation or download in advance as described above may be those which realize the function in cooperation with the OS (operating system) or the like in the interior of the apparatus.

The program may be a dynamically generated execution module.

The invention may be implemented in any other forms without departing from its spirits and principal characteristics. Therefore, the embodiments shown above are only examples, and should not be understood exclusively. The scope of the invention is described in claims, and is not bound by the text of this specification. In addition, all the modifications, improvements, alternatives, and reformations involved in a scope equivalent to the claims are included in the invention.

As described above in detail, according to the invention, in so-called an image forming apparatus of an in-body paper discharging type, a technology which achieves improvement of convenience in handling the sheet discharged from the apparatus is provided.

What is claimed is:

1. An image forming apparatus comprising:

an image scanning unit arranged on an upper portion of the apparatus to scan an image of an original document;

a discharge tray provided below the image scanning unit at least partly to receive a sheet discharged from a discharge port of the apparatus;

a holding unit having a sheet receiver and holding the sheet received by the sheet receiver; and a moving mechanism configured to move the holding unit between a sheet receiving position which is above the discharge tray to receive the sheet discharged from the discharge port by the sheet receiver of the holding unit and a retracted position at which the holding unit is retracted from above the discharge tray so as to avoid abutment with the sheet placed on the discharge tray, wherein the holding unit in the retracted position is on a front side of the image forming apparatus.

2. The apparatus of claim 1, wherein the holding unit is formed into a box shape having an opening to receive the sheet on the side opposing the discharge port when the holding unit is positioned at the sheet receiving position.

3. The apparatus of claim 1, further comprising:

a movement control unit configured to control the movement of the holding unit by the moving mechanism, wherein the movement control unit sorts the sheets to be stacked on the sheet receiver of the holding unit by controlling the movement of the holding unit within a range of movement from the sheet receiving position to the retracted position.

4. The apparatus according to claim 1, further comprising:

a movement control unit configured to control the movement of the holding unit by the moving mechanism; and a job information acquiring unit configured to acquire information relating to the state of execution of a printing job in the image forming apparatus;

wherein the movement control unit moves the holding unit to the sheet receiving position when the execution of the printing job by the image forming apparatus is started and moves the holding unit to the retracted position when the execution of the printing job by the image forming apparatus is completed on the basis of the information acquired by the job information acquiring unit.

5. The apparatus of claim 1, further comprising:

a movement control unit configured to control the movement of the holding unit by the moving mechanism; and a sheet detecting unit configured to detect the presence or absence of the sheet on the discharge tray, wherein the movement control unit does not move the holding unit to the sheet receiving position when the sheet detecting unit detects the presence of the sheet on the discharge tray.

6. The apparatus of claim 1, further comprising:

a movement control unit configured to control the movement of the holding unit by the moving mechanism; and a full detecting unit configured to detect whether or not the number of sheets held in the holding unit exceeds a predetermined marginal holdable number, wherein the movement control unit does not move the holding unit to the sheet receiving position when the full detecting unit detects that the number of sheets held in the holding unit exceeds the marginal holdable number.

7. The apparatus of claim 1, further comprising:

a movement control unit configured to control the movement of the holding unit by the moving mechanism; and a holding sheet detecting unit configured to detect the presence or absence of the sheets held in the holding unit, wherein the movement control unit does not move the holding unit to the sheet receiving position when the holding sheet detecting unit detects that the holding unit holds the sheet.

8. A method of managing a discharged sheet in an image forming apparatus having an image scanning unit arranged on an upper portion of the apparatus to scan an image of an original document, a discharge tray provided below the image scanning unit at least partly to receive the sheet discharged from a discharge port of the apparatus, a holding unit having a sheet receiver and holding the sheet received by the sheet receiver, the method comprising:

moving the holding unit between a sheet receiving position which is above the discharge tray to receive sheet discharged from the discharge port by the sheet receiver of the holding unit and a retracted position at which the holding unit is retracted from above the discharge tray so as to avoid abutment with the sheet placed on the discharge tray, wherein the holding unit in the retracted position is on a front side of the image forming apparatus.

9. The method of claim 8, wherein the holding unit is formed into a box shape having an opening to store the sheet on the side opposing the discharge port when the holding unit is positioned at the sheet receiving position.

10. The method of claim 8, wherein the sheets to be stacked on the sheet receiver of the holding unit are sorted by controlling the movement of the holding unit within a range of movement from the sheet receiving position to the retracted position.

11. The method of claim 8, further comprising:

acquiring information relating to the state of execution of a printing job in the image forming apparatus, wherein the holding unit is moved to the sheet receiving position when the execution of the printing job by the image forming apparatus is started and the holding unit is moved to the retracted position when the execution of the printing job by the image forming apparatus is completed on the basis of the acquired information.

12. The method of claim 8, wherein the presence or absence of the sheet on the discharge tray is detected, and the holding unit is not moved to the sheet receiving position when the presence of the sheet on the discharge tray is detected.

13. The method of claim 8, wherein whether or not the number of sheets held in the holding unit exceeds a predetermined marginal holdable number is detected, and the holding unit is not moved to the sheet receiving position when the fact that the number of sheets held in the holding unit exceeds the marginal holdable number is detected.

14. The method of claim 8, wherein the presence or absence of the sheets held in the holding unit is detected; and the holding unit is not moved to the sheet receiving position when the fact that the holding unit holds the sheet is detected.

* * * * *